US011414895B2

(12) United States Patent
Miller et al.

(10) Patent No.: US 11,414,895 B2
(45) Date of Patent: Aug. 16, 2022

(54) SYSTEMS AND METHODS FOR AUTOMATED CAPTURE AND RECOVERY OF TAG AND TACK

(71) Applicants: Channing E. Miller, Fort Lauderdale, FL (US); Edward P. Ellers, Boca Raton, FL (US)

(72) Inventors: Channing E. Miller, Fort Lauderdale, FL (US); Edward P. Ellers, Boca Raton, FL (US)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 178 days.

(21) Appl. No.: 16/740,036

(22) Filed: Jan. 10, 2020

(65) Prior Publication Data

US 2020/0224460 A1 Jul. 16, 2020

Related U.S. Application Data

(60) Provisional application No. 62/791,688, filed on Jan. 11, 2019.

(51) Int. Cl.
*E05B 73/00* (2006.01)
*G08B 13/24* (2006.01)

(52) U.S. Cl.
CPC ..... *E05B 73/0047* (2013.01); *E05B 73/0017* (2013.01); *E05B 73/0064* (2013.01); *G08B 13/2434* (2013.01); *E05B 73/0052* (2013.01)

(58) Field of Classification Search
CPC ..... E05B 73/0017; E05B 73/0047; E05B 73/0052; E05B 73/0058; E05B 73/0064; G08B 13/2428; G08B 13/2434
See application file for complete search history.

(56) References Cited

U.S. PATENT DOCUMENTS 5,426,419 A 6/1995 Nguyen et al.
5,528,914 A * 6/1996 Nguyen ..... E05B 73/0064 70/57.1
5,942,978 A * 8/1999 Shafer ..... E05B 73/0017 340/572.9
7,382,256 B2 * 6/2008 Skjellerup ..... E05B 73/0017 235/375

(Continued)

FOREIGN PATENT DOCUMENTS

EP 1505551 A2 2/2005
WO 2017012892 A 1/2017

OTHER PUBLICATIONS

International Search Report and Written Opinion issued for PCT/US2020/013148, dated May 7, 2020.

*Primary Examiner* — Christopher J Boswell
(74) *Attorney, Agent, or Firm* — ArentFox Schiff LLP

(57) ABSTRACT

Systems and methods for operating a tag detacher. The methods comprise: receiving a tag body of a security device in a nest of the tag detacher; actuating a detachment mechanism of the tag detacher so as to cause a release of a tack assembly from a securement mechanism located within the tag body of the security device; allowing the tag body to travel out of a nest by at least rotating a portion of the nest so that the nest transitions between a home position and a pivoted position; and returning the nest to the home position when the tag body no longer resides in the nest.

23 Claims, 24 Drawing Sheets

(56) References Cited

U.S. PATENT DOCUMENTS

| | | | | |
|---|---|---|---|---|
| 9,019,081 | B2 * | 4/2015 | Stewart | E05B 73/0064 340/10.5 |
| 9,183,718 | B2 * | 11/2015 | Bergman | E05B 73/0047 |
| 9,218,730 | B2 * | 12/2015 | Nguyen | E05B 73/0017 |
| 11,066,851 | B2 * | 7/2021 | Perez | E05B 73/0017 |
| 2009/0128341 | A1 | 5/2009 | Skjellerup et al. | |
| 2014/0055249 | A1 * | 2/2014 | Garner | E05B 73/0047 340/10.51 |

* cited by examiner

1000

SYSTEMS AND METHODS FOR AUTOMATED CAPTURE AND RECOVERY OF TAG AND TACK

CROSS-REFERENCE TO RELATED APPLICATIONS

The present application claims priority to U.S. Provisional Patent Application Ser. No. 62/791,688 which was filed on Jan. 11, 2019. The content of this U.S. Provisional Patent Application is incorporated herein in its entirety.

BACKGROUND

Statement of the Technical Field

The present disclosure relates generally to inventory systems. More particularly, the present disclosure relates to implementing systems and methods for automated capture and recovery of tag and tack (e.g., during or as part of a tag detachment process).

Description of the Related Art

Electronic Article Surveillance ("EAS") systems are often used by retail stores in order to minimize loss due to theft. One common way to minimize retail theft is to attach a security tag to an article such that an unauthorized removal of the article can be detected. In some scenarios, a visual or audible alarm is generated based on such detection. For example, a security tag with an EAS element (e.g., an acousto-magnetic element) can be attached to an article offered for sale by a retail store. An EAS interrogation signal is transmitted at the entrance and/or exit of the retail store. The EAS interrogation signal causes the EAS element of the security tag to produce a detectable response if an attempt is made to remove the article without first detaching the security tag therefrom. The security tag must be detached from the article upon purchase thereof in order to prevent the visual or audible alarm from being generated.

One type of EAS security tag can include a tag body which engages a tack. The tack usually includes a tack head and a sharpened pin extending from the tack head. In use, the pin is inserted through the article to be protected. The shank or lower part of the pin is then locked within a cooperating aperture formed through the housing of the tag body. In some scenarios, the tag body may contain a Radio Frequency Identification ("RFID") element or label. The RFID element can be interrogated by an RFID reader to obtain RFID data therefrom.

The EAS security tag may be removed or detached from the article using a detaching unit. Examples of such detaching units are disclosed in U.S. Pat. No. 5,426,419 ("the '419 patent), U.S. Pat. No. 5,528,914 ("the '914 patent"), U.S. Pat. No. 5,535,606 ("the '606 patent"), U.S. Pat. No. 5,942,978 ("the '978 patent") and U.S. Pat. No. 5,955,951 ("the '951 patent"). The detaching units disclosed in the listed patents are designed to operate upon a two-part hard EAS security tag. Such an EAS security tag comprises a pin and a molded plastic enclosure housing EAS marker elements. During operation, the pin is inserted through an article to be protected (e.g., a piece of clothing) and into an aperture formed through at least one sidewall of the molded plastic enclosure. The pin is securely coupled to the molded plastic enclosure via a clamp disposed therein. The pin is released by a detaching unit via a probe. The probe is normally retracted within the detaching unit. Upon actuation, the probe is caused to travel out of the detaching unit and into the enclosure of the EAS security tag so as to release the pin from the clamp or disengage the clamp from the pin. Once the pin is released from the clamp, the EAS security tag can be removed from the article.

SUMMARY

The present disclosure concerns implementing systems and methods for operating a tag detacher. The methods comprise: receiving a tag body of a security device in a nest of the tag detacher; actuating a detachment mechanism of the tag detacher so as to cause a release of a tack assembly from a securement mechanism located within the tag body of the security device; allowing the tag body to travel out of a nest by at least rotating a portion of the nest so that the nest transitions between a home position and a pivoted position; and returning the nest to the home position when the tag body no longer resides in the nest.

In some scenarios, the methods also comprise determining, by the tag detacher, whether the tag body is properly placed in the nest, prior to an actuation of the detachment mechanism. The tag detacher outputs a prompt for adjusting the tag body's position within the nest, when a determination is made that the tag body is not properly placed in the nest. A latch mechanism is actuated to secure the tag body to the tag detacher, when a determination is made that the tag body is properly placed in the nest.

In those or other scenarios, the tag detacher performs operations to determine whether there are any obstructions preventing access to the tack assembly, prior to an actuation of the detachment mechanism. The tag detacher may output a prompt for causing an individual to check for obstructions preventing access to the tack assembly, when a determination is made that there is an obstruction preventing access to the tack assembly.

In those or other scenarios, the tag detacher performs operations to move a shield in proximity to the tack assembly, prior to an actuation of the detachment mechanism. The shield may be used to clamp an article to the tag detacher. The shield may be moved out of proximity of the tack assembly, after the actuation of the detachment mechanism.

In those or other scenarios, the tag detacher performs capturing operations to capture the tack assembly. The capturing operations comprise actuating a mechanical device to grasp the tack assembly, generating a magnetic field so as to cause the tack assembly to move in a direction away from the tag body, or operating a vacuum to cause the tack assembly to move in a direction away from the tag body. The captured tack assembly may be moved over a storage container and released so that the tack assembly travels into the storage container.

BRIEF DESCRIPTION OF THE DRAWINGS

The present solution will be described with reference to the following drawing figures, in which like numerals represent like items throughout the figures.

DETAILED DESCRIPTION

Figure 1:
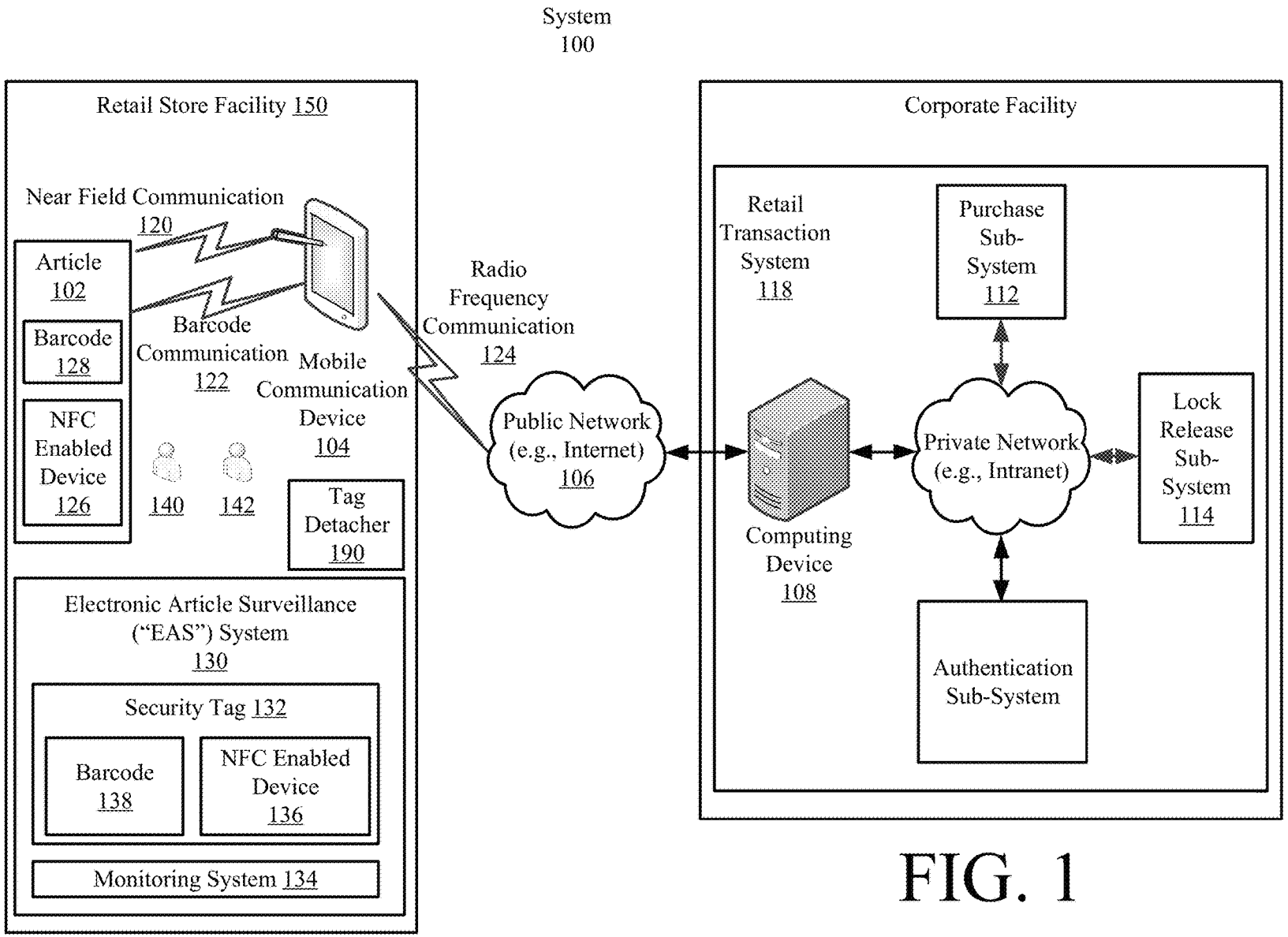
FIG. 1 is an illustration of an illustrative system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Mobile shopping apps, shopping websites and self-checkout solutions are becoming more prevalent in retail stores. Presently, there is no way for a retail store to provide a customer with a frictionless tack and tag body removal, i.e., meaning that a sales associate or customer does not have to manually remove from an article either the tack or tag body.

Today, the two separate parts (i.e., the tack and the tag body) that make up the security device have to be manually removed from retail articles by the sales associate. This takes time (sometimes longer and more difficult than expected) and can be exacerbated by many factors. For example, if the person performing the removal of the security device from an article is not thoroughly trained, then the timing of the security device removal is relatively long possibly because the article is difficult to work with and/or a sufficient grip on the small tack head is hard to achieve. Other difficulties and problems arise from the sales associate using the article to pull out the tack head from the tag body, thus causing damage to the article (e.g., fabric). As a result of this damage, the article may be rendered non-saleable and a loss in inventory is caused. Once the tack and tag body are removed from the article, the sales associate is supposed to manually place the removed parts into a container—a bucket, a bin or a box. In some cases, the removed parts are not properly placed in the container and/or misplaced.

The present solution provides a way to overcome the drawbacks of the conventional solution by providing an automatic capture and recovery of the tack and tag body during or after a tag detachment process. The automated security device capture and recovery solution is based on the idea that an automated mechanical, electro-mechanical, magnetic and/or vacuum system would perform the actions of removing the tack from an article, placing the removed tack in a first container for storage, and placing the tag body in a second container for storage. This automated removal of the security device streamlines the security device detachment process by eliminating the variance of human involvement, frees up sales associates for other customer facing opportunities, removes frustration over having to perform an often difficult and problematic task of removing the tags, decreases lost inventory cost, decreases check-out que time, increases cleanliness and inventory control, and increases safety. The automated security device capture and recovery solution can be implemented in a Point of Sale ("POS") device (mobile or fixed) and/or a kiosk as part of a check-out system (e.g., a cashier-staffed checkout system and/or a self-checkout system).

Once the article is purchased at a POS or kiosk, the security device must be removed so as to not cause an alarm to be issued by a security device (e.g., an EAS and/or RFID system) when the article is leaving the store. The automated system only requires an individual (e.g., the sales associate or customer) to place the security device in a nest of a detacher for tag removal. The detacher can include, but is not limited to, a mechanical detacher having a part number DM1000 which is available from Sensormatic by Johnson Controls. Once the security device properly resides in the detacher's nest, the operator is prompted (e.g., via a display, or other audio and/or visual indicators) to check that there are no obstructions blocking a removal of the tack or tag body. In response to a user-software interaction that there are no such obstructions, a shield is lowered (automatically or manually) so as to simultaneously (1) clamp the article to the tag detacher (e.g., by clamping or otherwise trapping the article between the shield and a housing of the tag detacher), and (2) energize the detacher for tack release. The shield has a hole formed therethrough that allows a head of the tack to be exposed when the security device is resting in the detacher's nest. This allows accessibility for the tack's automatic removal from the tag body. The tack is removed thru an automated mechanical, electro-mechanical, magnetic and/or vacuum system. The tack is captured by the automated system, and deposited into a specific container for storage.

The capturing/depositing of the tack may be achieved using an electro-magnet that is attached to a movable arm positioned over the detacher. When the tack is released from the tag body, the electro-magnet is turned on whereby magnetic attraction pulls the tack in an upwards direction away from the tag body. Consequently, the tag travels out of the tag body, through the article, and/or to a magnetic surface of the electro-magnet. The movable arm then moves the tack into proximity of a container. Once the tack is in proximity to the container, the electro-magnet is turned off so that the tack is released from the magnetic surface and deposited in the container. A door is opened so that a hole formed through the support structure is no longer obstructed or blocked, whereby the tag body falls into a storage container as a result of the gravitational force being applied to the tag body. The tag and tack storage containers may be part of a recirculation program, and may have specific size, construction and designed for return shipping. Once the cycle of tack/tag body removal is complete, the system resets for a next article/sensor removal session. The shield can now be lifted so that the article can be removed from the system.

Illustrative Systems

Referring now to FIG. 1, there is provided an illustration of an illustrative system 100. System 100 is generally configured to allow an individual to purchase an article 102 using a Mobile Communication Device ("MCD") 104 and to have a security tag 132 detached from the article 102 using a tag detacher 190. Security tags are well known in the art, and therefore will not be described here in detail. Any known or to be known security tag can be used herein without limitation. For example, the security tag comprises a tag having part number ZL303-G-100 and which is available from Tyco Retail Solutions (part of Johnson Controls) of Boca Raton, Fla. The security tag is designed to be used with a tack that is inserted through an article and into a tag body.

The tag detacher 190 is configured to facilitate the detachment of the security tag 132 from the article 102 in accordance with the conventional techniques (e.g., probe or magnet based techniques). In this regard, the tag detacher 190 employs wireless Short Range Communication ("SRC") technologies to facilitate the purchase of the article 102 and/or the detachment of the security tag 132 from the article 102. The wireless SRC technologies can include, but are not limited to, Near Field Communication ("NFC") technology, InfRared ("IR") technology, Wireless Fidelity ("Wi-Fi") technology, Radio Frequency Identification ("RFID") technology, and/or ZigBee technology. The tag detacher 190 may also employ barcode technology, electronic card reader technology, and Wireless Sensor Network ("WSN") communications technology.

As shown in FIG. 1, system 100 comprises a Retail Store Facility ("RSF") 150 including an EAS system 130. The EAS system 130 comprises a monitoring system 134 and at least one security tag 132. Although not shown in FIG. 1, the security tag 132 is attached to article 102, thereby protecting the article 102 from an unauthorized removal from the retail store facility 150. The monitoring system 134 establishes a surveillance zone (not shown) within which the presence of the security tag 132 can be detected. The surveillance zone is established at an access point (not shown) for the retail store facility 150. If the security tag 132 is carried into the surveillance zone, then an alarm is triggered to indicate a possible unauthorized removal of the article 102 from the retail store facility 150.

During store hours, an individual 140 may desire to purchase the article 102. The individual 140 can purchase the article 102 without using a traditional fixed POS station (e.g., a checkout counter). Instead, the purchase transaction can be achieved using MCD 104. MCD 104 (e.g., a mobile phone or tablet computer) can be in the possession of the individual 140 or store associate 142 at the time of the purchase transaction. Notably, MCD 104 has a retail transaction application installed thereon that is configured to facilitate the purchase of article 102 and the management/control of the tag detacher operations for an attachment/detachment of the security tag 132 to/from article 102. The retail transaction application can be a pre-installed application, an add-on application or a plug-in application. Retail transaction applications are well known in the art, and therefore will not be described in detail herein. Any known or to be known retail transaction application can be used herein without limitation.

In order to initiate a purchase transaction, the retail transaction application is launched via a user-software interaction. The retail transaction application facilitates the exchange of data between the article 102, security tag 132, individual 140, store associate 142, and/or Retail Transaction System ("RTS") 118. For example, after the retail transaction application is launched, a user 140, 142 is prompted to start a retail transaction process for purchasing the article 102. The retail transaction process can be started simply by performing a user software interaction, such as depressing a key on a keypad of the MCD 104 or touching a button on a touch screen display of the MCD 104.

Subsequently, the user 140, 142 may manually input into the retail transaction application article information. Alternatively or additionally, the user 140, 142 places the MCD 104 in proximity of article 102. As a result of this placement, the MCD 104 and/or tag detacher 190 obtains article information from the article 102. The article information includes any information that is useful for purchasing the article 102, such as an article identifier and an article purchase price. In some scenarios, the article information may even include an identifier of the security tag 132 attached thereto. The article information can be communicated from the article 102 to the MCD 104 and/or tag detacher 190 via a short range communication, such as a barcode communication 122 or an NFC 120. In the barcode scenario, article 102 has a barcode 128 attached to an exposed surface thereof. In the NFC scenarios, article 102 may comprise an NFC enabled device 126. If the tag detacher 190 obtains the article information, then the tag detacher 190 forwards the article information to MCD 104 via a wireless SRC, such as a Bluetooth communication.

Thereafter, payment information is input into the retail transaction application of MCD 104 by the user 140, 142. Upon obtaining the payment information, the MCD 104 automatically performs operations for establishing a retail transaction session with the RTS 118. The retail transaction session can involve: communicating the article information and payment information from MCD 104 to the RTS 118 via an RF communication 124 and public network 106 (e.g., the Internet); completing a purchase transaction by the RTS 118; and communicating a response message from the RTS 118 to MCD 104 indicating that the article 102 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or Google Wallet®).

The purchase transaction can be completed by the RTS 118 using the article information and payment information. In this regard, such information may be received by a computing device 108 of the RTS 118 and forwarded thereby to a sub-system of a private network 100 (e.g., an Intranet). For example, the article information and purchase information can also be forwarded to and processed by a purchase sub-system 112 to complete a purchase transaction. When the purchase transaction is completed, a message is generated and sent to the MCD 104 indicating whether the article 102 has been successfully or unsuccessfully purchased.

If the article 102 has been successfully purchased, then a security tag detaching process can be started automatically by the RTS 118 or by the MCD 104. Alternatively, the user 140, 142 can start the security tag detaching process by performing a user-software interaction using the MCD 104. In all three scenarios, the article information can optionally be forwarded to and processed by a lock release sub-system 114 to retrieve a detachment key or a detachment code that is useful for detaching the security tag 132 from the article 102. The detachment key or code is then sent from the RTS 118 to the MCD 104 such that the MCD 104 can perform or cause the tag detacher 190 to perform tag detachment operations. The tag detachment operations are generally configured to cause the security tag 132 to actuate a detaching mechanism (not shown in FIG. 1). In this regard, the MCD or tag detacher generates a detach command and sends a detach signal including the detach command to the tag detacher 190. The tag detacher 190 authenticates the detach command and activates the detaching mechanism (e.g., a probe or magnet). For example, the detach command causes: (a) a detachment mechanism to enter an insert space formed in the housing of the security tag 132, travel through an arcuate channel towards a securement mechanism, engage the securement mechanism, and apply a pushing force on the securement mechanism; (b) a magnetic field to be applied to the security tag 132 for releasing a tack from a lock inside the tag body; (c) an external grasping mechanism to grasp the tack head and pull the tag in a direction away from the tag body; and/or (d) a magnetic field to be applied or a vacuum to activated so as to cause the tack to travel up and away from the tag body and article. Once the security tag 132 has been removed from article 102, the customer 140 can carry the article 102 through the surveillance zone without setting off the alarm.

Referring now to FIGS. 2-7, there is provided illustrations useful for understanding operations of the security tag 132. Security tag 132 is described below as a security tag with a clamping securement mechanism that is actuated using a tool inserted into the security tag's housing. The present solution is not limited to such security tag configurations. The present solution can be used with any other type of security tag architecture.

As shown in FIGS. 2-7, the security tag 132 includes a tag body 202 formed of a housing 310 with an upper housing member 304 joined to a lower housing member 306. The housing members 304, 306 can be joined together via an adhesive, a mechanical coupling means (e.g., snaps, screws, etc.), or a weld (e.g., an ultrasonic weld). The housing 310 can be made from a rigid or semi-rigid material, such as plastic. The housing 310 has an opening 206 formed therein such that at least a portion of a tack assembly 204 (or attachment element) can be inserted into the tag body for facilitating the attachment of the security tag to an article 102 (e.g., a piece of clothing). EAS and/or RFID components (not shown) is(are) contained within the housing 310. EAS and RFID components of security tags are well known in the art, and therefore will not be described herein. Any known or to be known EAS and/or RFID component can be used herein without limitation.

Tack assembly 204 has a tack head 210 and an elongate tack body 208 extending down and away from the tack head. The tack body 208 is sized and shaped for insertion into opening 206 and removal from opening 206. A plurality of grooves 214 is formed along a length of the tack body 208 for engagement with a securement mechanism 406 disposed within the housing 310. When the grooves are engaged by the securement mechanism 406, the security tag 132 is secured to the article 102. Thereafter, unauthorized removal of the article 102 from a controlled area (e.g., RSF 150 of FIG. 1) can be detected by a monitoring device of the EAS system 130. Such monitoring devices are well known in the art, and therefore will not be described herein. Still, it should be understood that at least one sensor (not shown in FIGS. 1-5) is disposed within the housing 310. The sensor includes, but is not limited to, an acoustically resonant magnetic sensor. In all cases, the sensor generates signals which can be detected by the monitoring device.

Such detection occurs when the security tag 132 is present within a surveillance zone (or interrogation zone) established by the monitoring system 134. The surveillance zone (or interrogation zone) is usually established at an access point for the controlled area (e.g., adjacent to a retail store entrance and/or exit). If the article 102 enters the surveillance zone (or interrogation zone) with the security tag 132, then an alarm may be triggered to indicate possible unauthorized removal thereof from the controlled area. In contrast, if the article 102 is authorized for removal from the controlled area, then the security tag 132 thereof can be deactivated and/or detached therefrom using a detachment mechanism (e.g., a probe 302 or a magnet (not shown)) of the tag detacher 190. Consequently, the article 102 can be carried through the surveillance zone (or interrogation zone) without being detected by the monitoring system 134 and/or without triggering the alarm.

The probe 302 is sized and shaped to at least be partially slidingly inserted into and removed from an insert space 308 formed in the housing 310. When inserted into insert space 308, the probe 302 travels through an arcuate channel 502 so as to be guided towards the securement mechanism 406. In this regard, the probe 302 has a generally arcuate shape matching that of the arcuate channel 502. Upon engagement with the securement mechanism 406, the probe 302 releases the tack body 208 therefrom. Next, the tack body 208 can be removed from the housing, so as to decouple the security tag 132 from the article 102.

Figure 5:
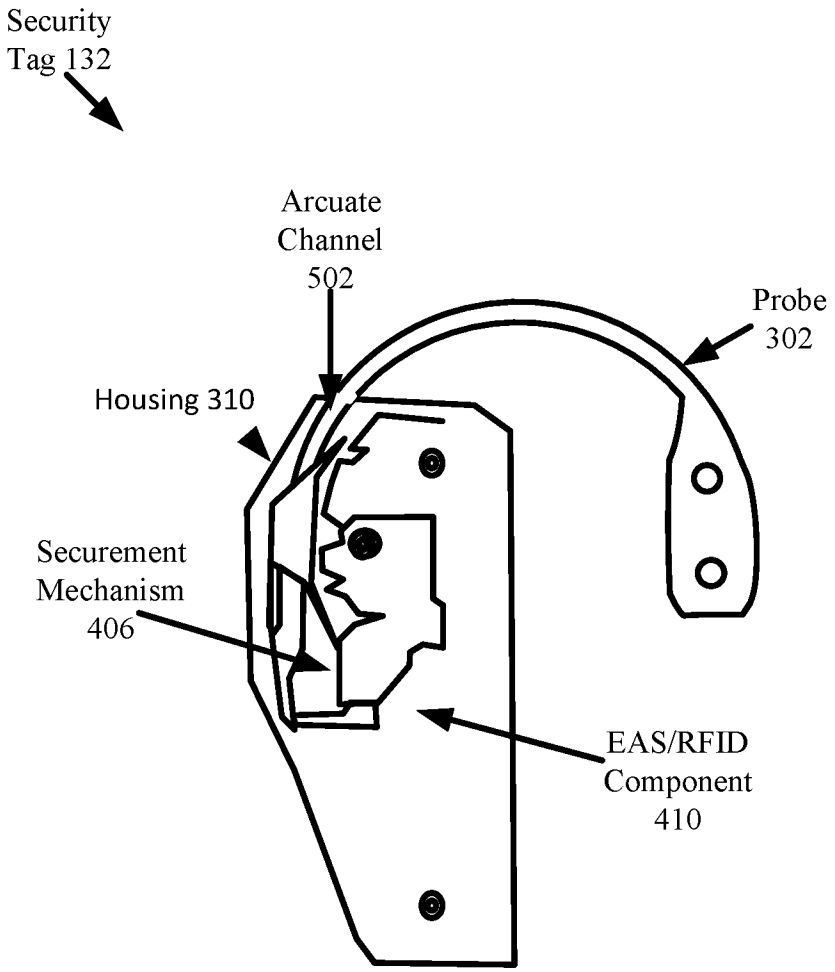
FIGS. 5-6 provide illustrations that are useful for understanding how the tack assembly can be released using a detachment mechanism.
Figure 6:
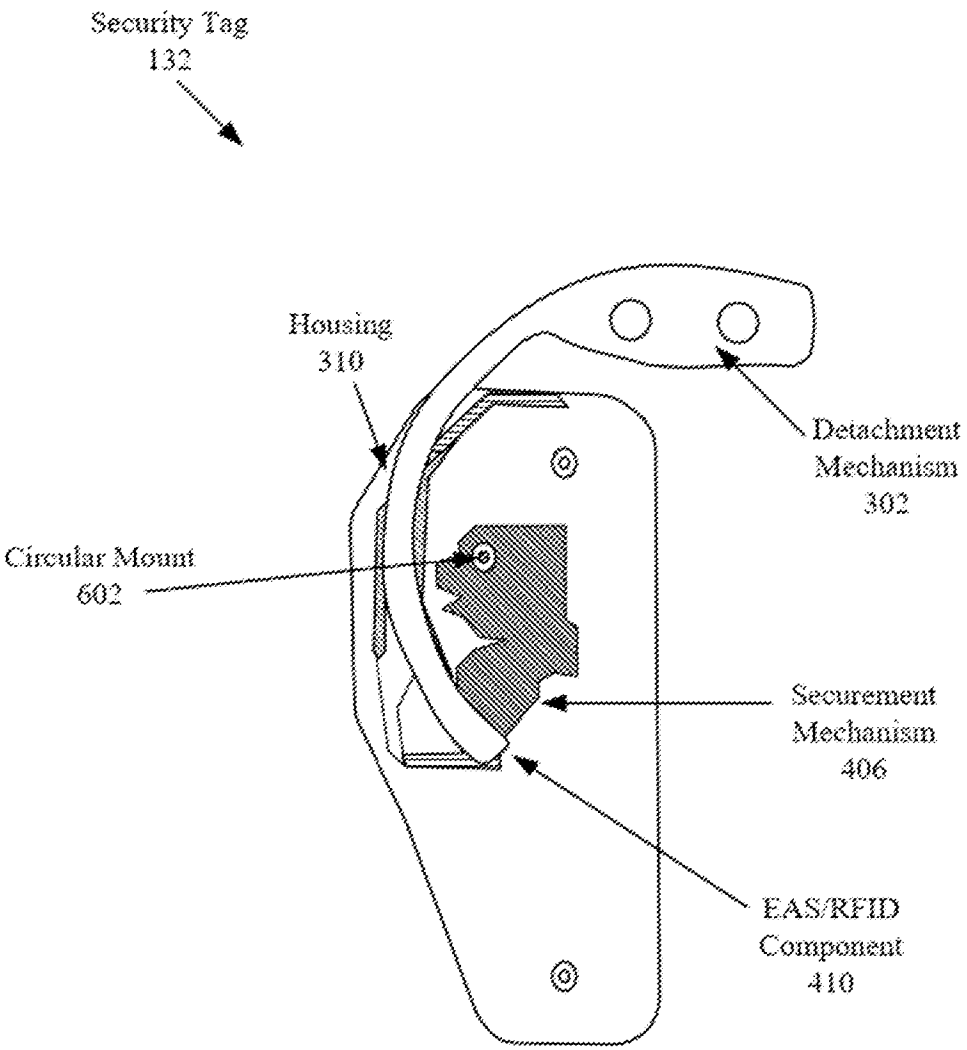
Figure 7:
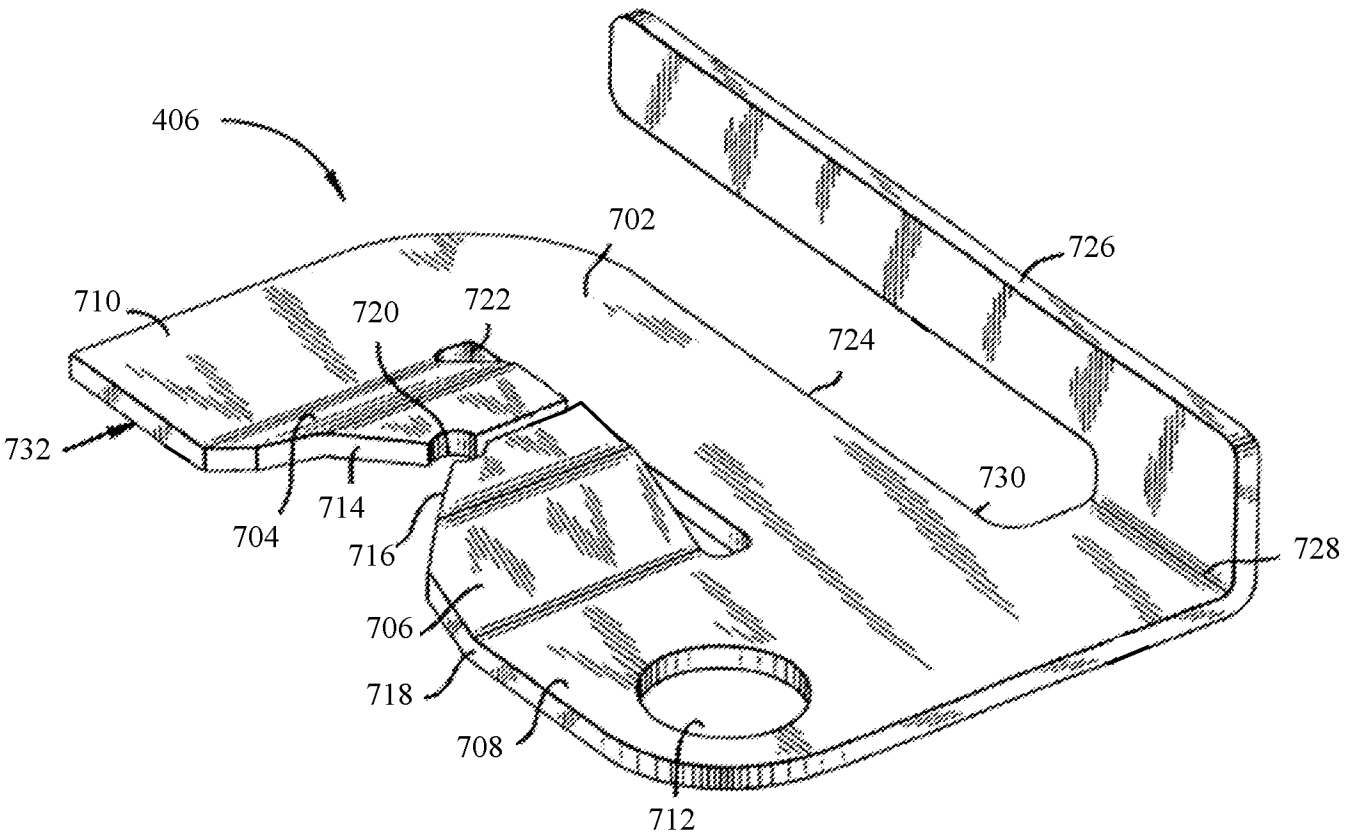
FIG. 7 is an illustration of a securement mechanism.

An illustration of the securement mechanism 406 is provided in FIG. 7. As noted above, the securement mechanism 406 is specifically adapted to accommodate release of the tack body 208 via the arcuate probe 302 moving in the arcuate channel 502. The securement mechanism 406 is generally in the form of a spring clamp securely disposed within the housing 310 of the security tag so as to be pivotable (or rotatable) about an axis 408. In this regard, the spring clamp comprises a clamp body 702 and jaws 704, 706. The clamp body 702 includes a mounting part 708 extending laterally of jaw 706 and a release part 710 extending laterally of jaw 704. The mounting part 708 includes a mounting aperture 712 facilitating the pivotable movement of the securement mechanism 406 within the housing of the security tag. The pivotable movement allows the securement mechanism 406 to be transitioned by the arcuate probe 302 from a first position in which the tack assembly is locked thereto (as shown in FIG. 5) and a second position in which the tack assembly is released or unlocked therefrom (as shown in FIG. 6).

Each of the jaws 704, 706 extends outwardly of the plane of the clamp body 702 and then inwardly toward the other jaw. The jaws 704, 706 terminate in facing edges 714, 716. These edges extend from a common edge 718 of the clamp body 702 inwardly toward each other, then curve outwardly away from each other to define an aperture 720 (typically, circular or elliptical) for receiving the tack body 208. The edges 714, 716 then continue in aligned fashion and end in an elongated, lateral slot 722 in the clamp body 702. The lateral slot lies inward of a further clamp body edge 724 which opposes the clamp body edge 718.

A further laterally extending elongated spring sleeve 726 is attached by a joint area 728 to the side 730 of the edge 724 bordering the mounting part 708. The sleeve 726 extends along the length of the edge 724 and is also out of the plane of the clamp body 702.

For mounting and supporting the spring clamp 702, the lower housing member 306 of the security tag 132 includes a circular mount 602. The spring clamp 406 is mounted, via aperture 712 of the mounting part 708, on the circular mount 602. In this way, the mounting part 708 can be rotated about the circular mount 602. The spring clamp 702 is thus able to pivot about the mounting part 708.

When an end of the tack assembly 204 is introduced in the downward direction through the opening 206 in the upper housing member 304, the tack body 208 is directed to aperture 720 of the securement mechanism 706. This causes the jaws 704, 706 to spread open and allow the tack body 208 to pass there through.

When the downward movement of the tack assembly 204 is stopped, the jaws 704, 706 retract and clutch the tack body 208. In this position, the jaws 704, 706 prevent upward movement of the tack assembly 204. As such, the security tag 132 becomes securely coupled to the article 102.

In order to release the tack body 208 from the jaws 704-706, the probe 302 is introduced into the insert space 308 formed in the housing 310 of the security tag 132. Rotation of the probe 302 causes it to be moved in and guided by the arcuate channel 502 until the end 312 abuts portion 732 of the securement mechanism 406. Continued rotational movement of the probe 302 causes force to be applied to portion 732 of the securement mechanism 406. This force, in turn, causes the clamp body 702 to rotate about the support area 708. The jaw 704 is thus enabled to spread away from jaw 706 due to the force of the tack body 208, which is being held stationary by jaw 706. As a result, aperture 720 expands, releasing the tack body 208 from the clutch of the jaws. The tack assembly 204 can now be moved in the upward direction past the jaws, via an upward force on the tack head 210.

During rotation of the clamp body 702, the spring sleeve 726 at the joint area 728 is compressed. After the tack assembly 204 is separated from the housing 310, the probe 302 is rotated in the reverse direction. This reverse rotation disengages the probe 302 from the securement mechanism 406. Consequently, the spring sleeve 726 rotates in an opposite direction so as to be brought back to its original position. Thereafter, the probe 302 is guided out of the arcuate channel 502 and is removed from insert space 312 formed in the housing 310.

As evident from the above discussion, the probe 302 is provided to deflect the securement mechanism 406 so as to allow the tack assembly 204 to be removed from the housing 310. The probe 302 is part of the external tag detacher 190. When the tack assembly 204 is removed from the housing 310, the security tag 132 can be decoupled from an article 102 (e.g., a piece of clothing).

Figure 2:
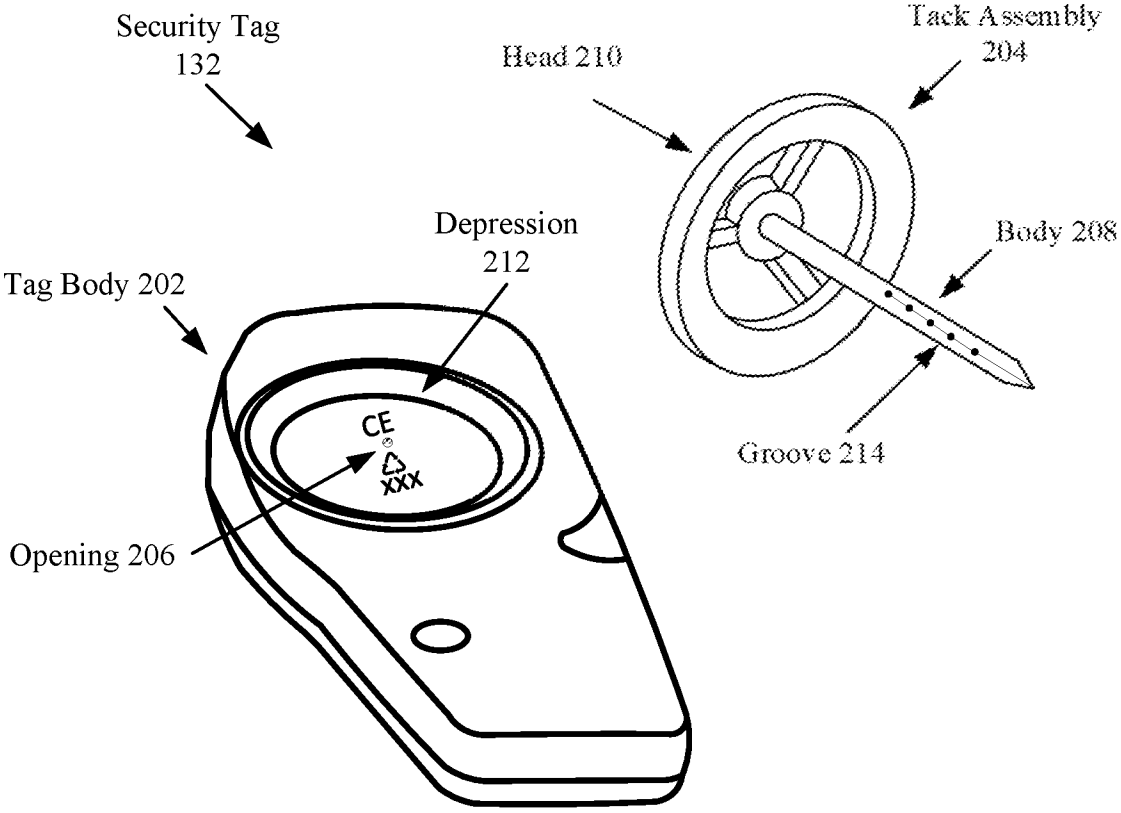
FIG. 2 is an illustration of the security tag with a tack assembly removed therefrom.
Figure 3:
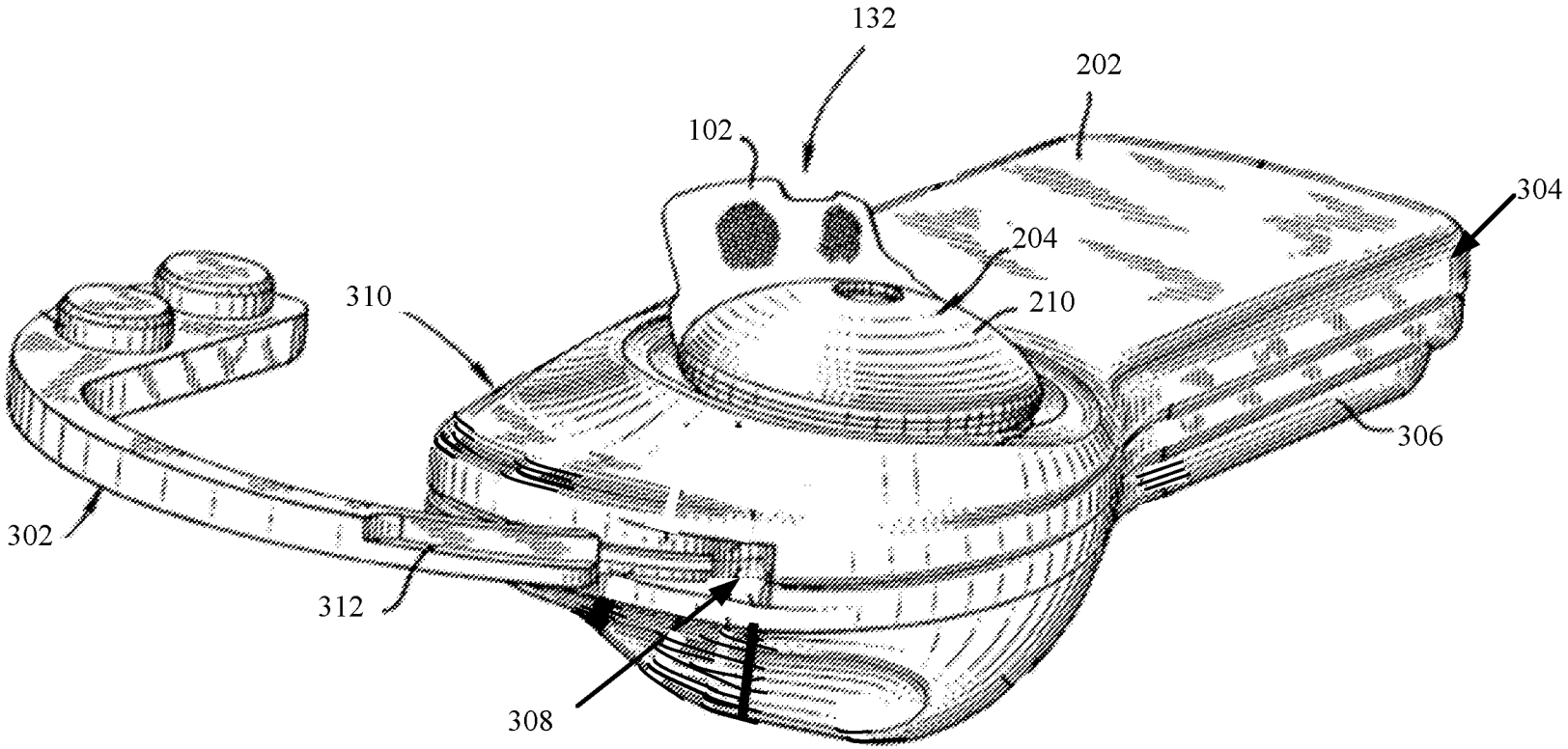
FIG. 3 is an illustration of the security tag with the tack assembly coupled thereto.
Figure 4:
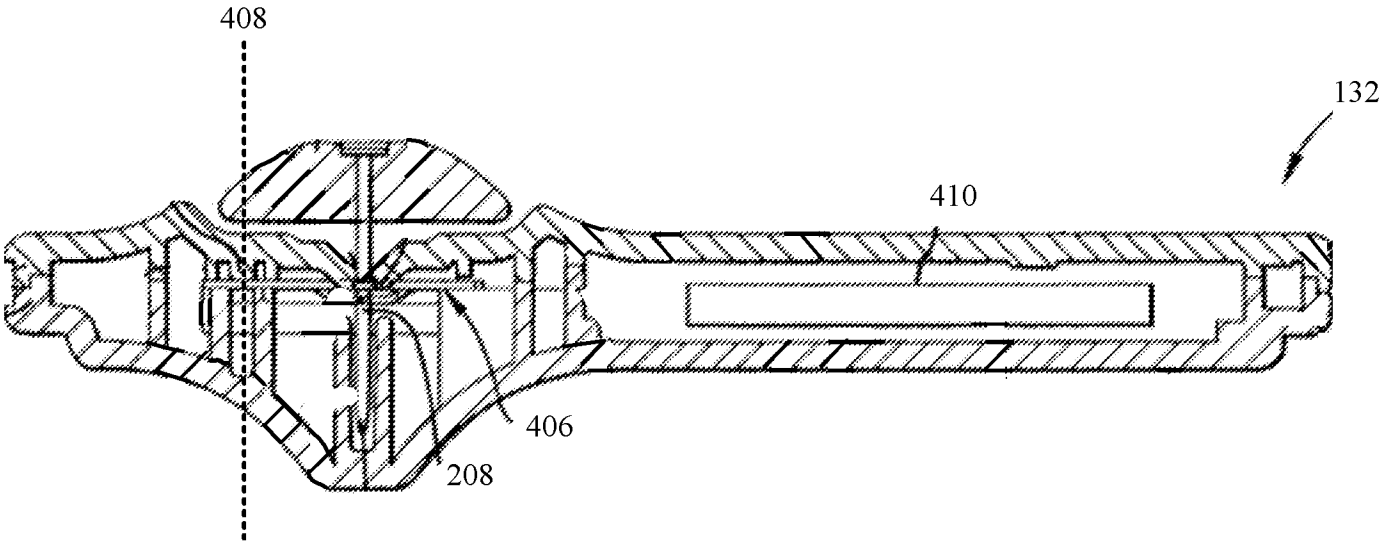
FIG. 4 is a cross sectional view of the security tag with the tack assembly coupled thereto.

Referring now to FIGS. 8A-8D, there are provided illustrations that are useful for understanding another illustrative tack assembly 800 which can be used with a tag body (e.g., tag body 202 of FIG. 2). The tack assembly 800 comprises a telescoping tack head 802 and a tack body 810. The telescoping tack head 802 comprises a plurality of concentric parts 804, 806, 808 which slide into and out of each other. When slid into each other, the overall size of the telescoping tack head 802 is reduced. This reduced size of the telescoping tack head 802 results in a decreased interference with a person's handling of and an aesthetic appeal of an object to which a security tag is attached.

Figure 8A:
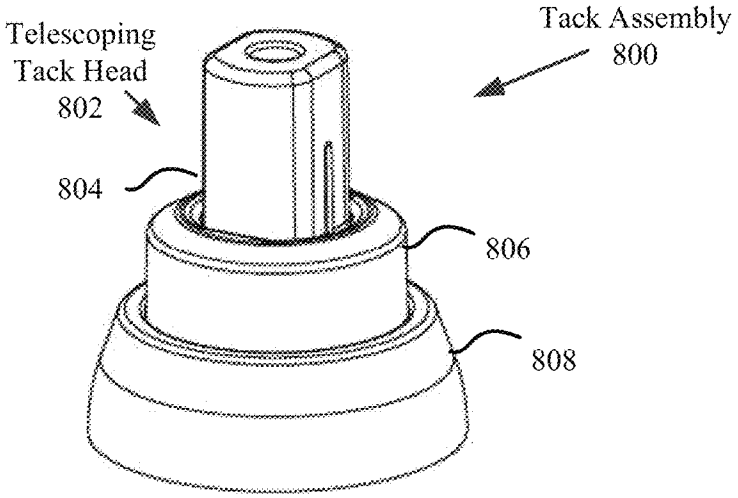
FIGS. 8A-8D (collectively referred to as "FIG. 8") provide illustrations that are useful for understanding another illustrative tack assembly.

The tack body 810 is securely coupled to the telescoping tack head 802. This secure coupling can be achieved using any known coupling means, such as an adhesive, mating threads or chemical bond. The tack body 810 resides within the telescoping tack head 802 when the concentric parts 804, 806, 808 are fully slid out of each other as shown in FIGS. 8A and 8C. This feature of the tack assembly 800 reduces the chances that a user will incur an injury from the free sharp end 812 of the tack body 810 when the tack assembly 800 is decoupled from a tag body.

In contrast, a portion 816 of the tack body 810 extends through an aperture 814 formed in the tack head 802 when the concentric parts 804, 806, 808 are slid into each other as a result of a user's depression thereof. This portion 816 of the tack body 810 comprises one or more notches 818 formed thereon. The notch(es) 818 provide specific areas on the tack body 810 that can be engaged by a securement mechanism (e.g., securement mechanism 406 of FIG. 4) of a tag body. This portion 816 of the tack body 810 can be released from the tag body via an arcuate probe or other external tool as discussed above.

Figure 8B:
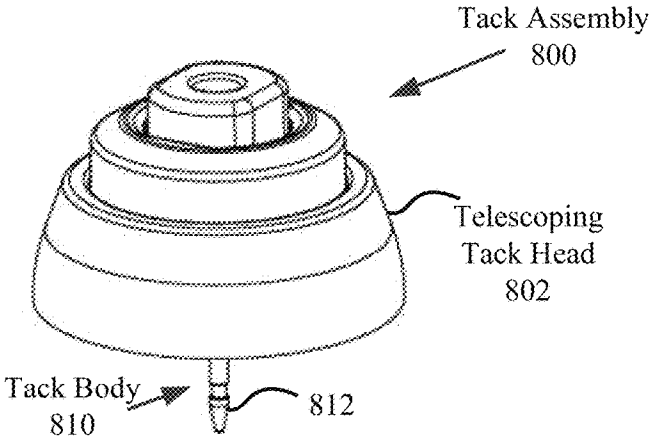
Figure 8C:
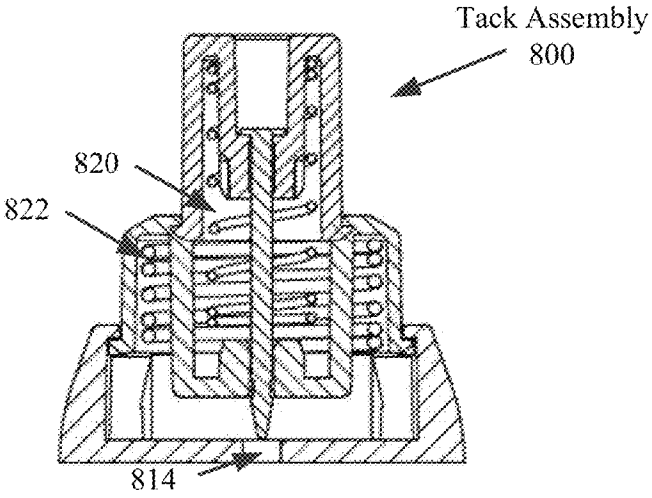
Figure 8D:
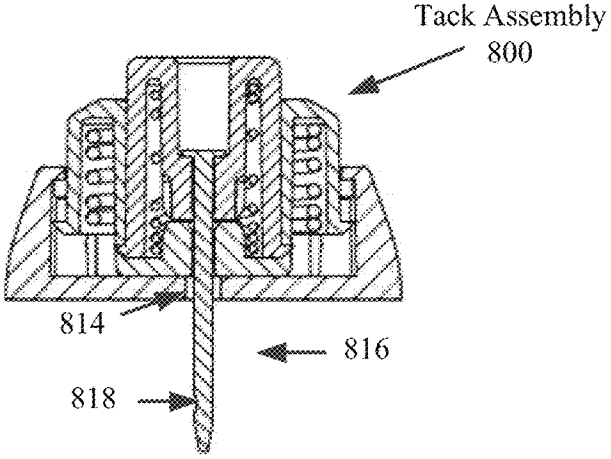
Figure 9C:
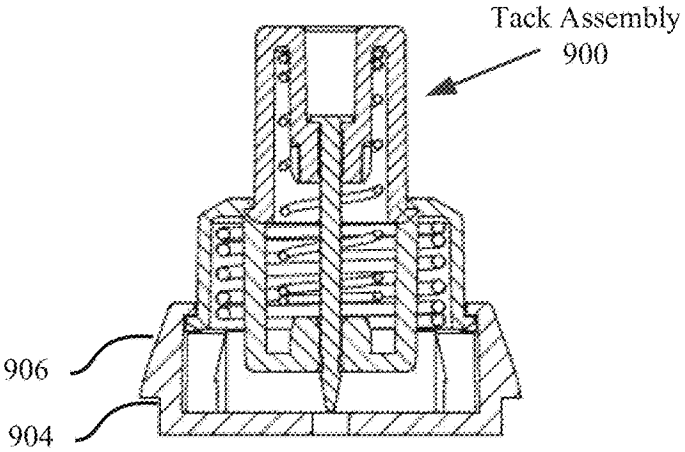
FIGS. 9A-9D (collectively referred to as "FIG. 9") provide illustrations that are useful for understanding another illustrative tack assembly.
Figure 9D:
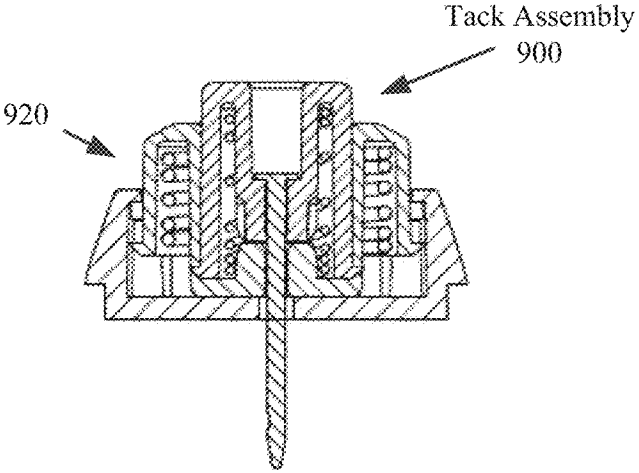
Figure 9A:
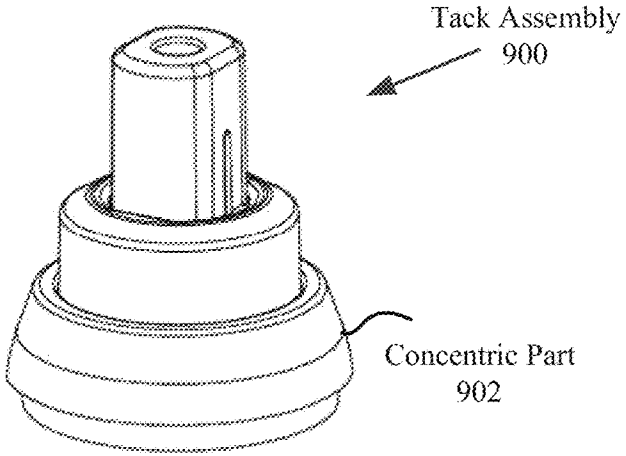
Figure 9B:
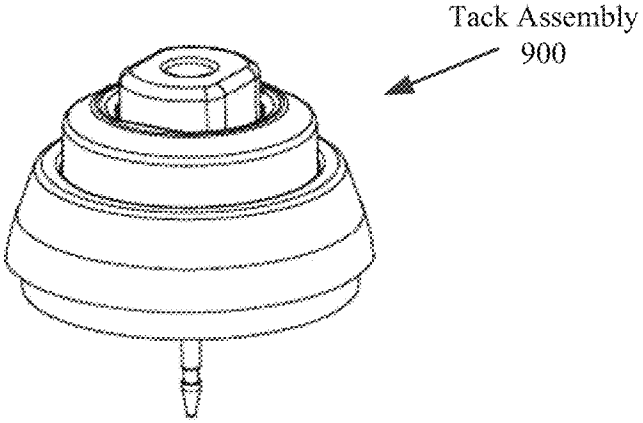

When released, the entire tack assembly 800 transitions from its engaged position shown in FIGS. 8B and 8D to its unengaged position shown in FIGS. 8A and 8C via springs 820, 822. In this regard, it should be understood that the springs 820, 822 are normally in an uncompressed state (shown in FIGS. 8A and 8C), but are in their compressed states (shown in FIGS. 8B and 8D) when the concentric parts 804, 806, 808 are slid into each other. The springs 820, 822 are held in their compressed states via the pin's capture by the securement mechanism of the tag body. The spring compression causes the concentric parts 804, 806, 808 to slide out of each other when the tack is released from the tag body so that the tack assembly 800 automatically returns to its unengaged position.

In some cases, the springs are selected so that the tack assembly 800 pops up and away from the tag body when the tack is released from the tag body. A magnet may be used here to capture the tack assembly 800 while in flight via its magnetic attraction with the tack 810 or other metal component of the tack assembly 800. The captured tack assembly 800 can then be placed in a collection bin for later reuse.

Referring now to FIGS. 9A-9D, there are provided illustrations that are useful for understanding another illustrative tack assembly 900. Tack assembly 900 is similar to tack assembly 800, except for the design of a concentric part 902. Concentric part 902 is designed to have an indented portion 904 and flange 906 for providing a means by which an external mechanism can grasp, grip or grab the tack assembly 900. The external mechanism can pull tack assembly 900 in a direction away from the tag body when the tack has been released from the tag body. In some scenarios, this tack architecture is used in self-checkout stations and/or kiosks having an electromechanical component for grasping, griping or grabbing the tack assembly 900.

Referring now to FIGS. 10-14, an illustrative tag detacher 1000 will be described. Tag detacher 190 of FIG. 1 is the same as or similar to tag detacher 1000. As such, the discussion of tag detacher 1000 is sufficient for understanding tag detacher 190 of FIG. 1.

Figure 16:
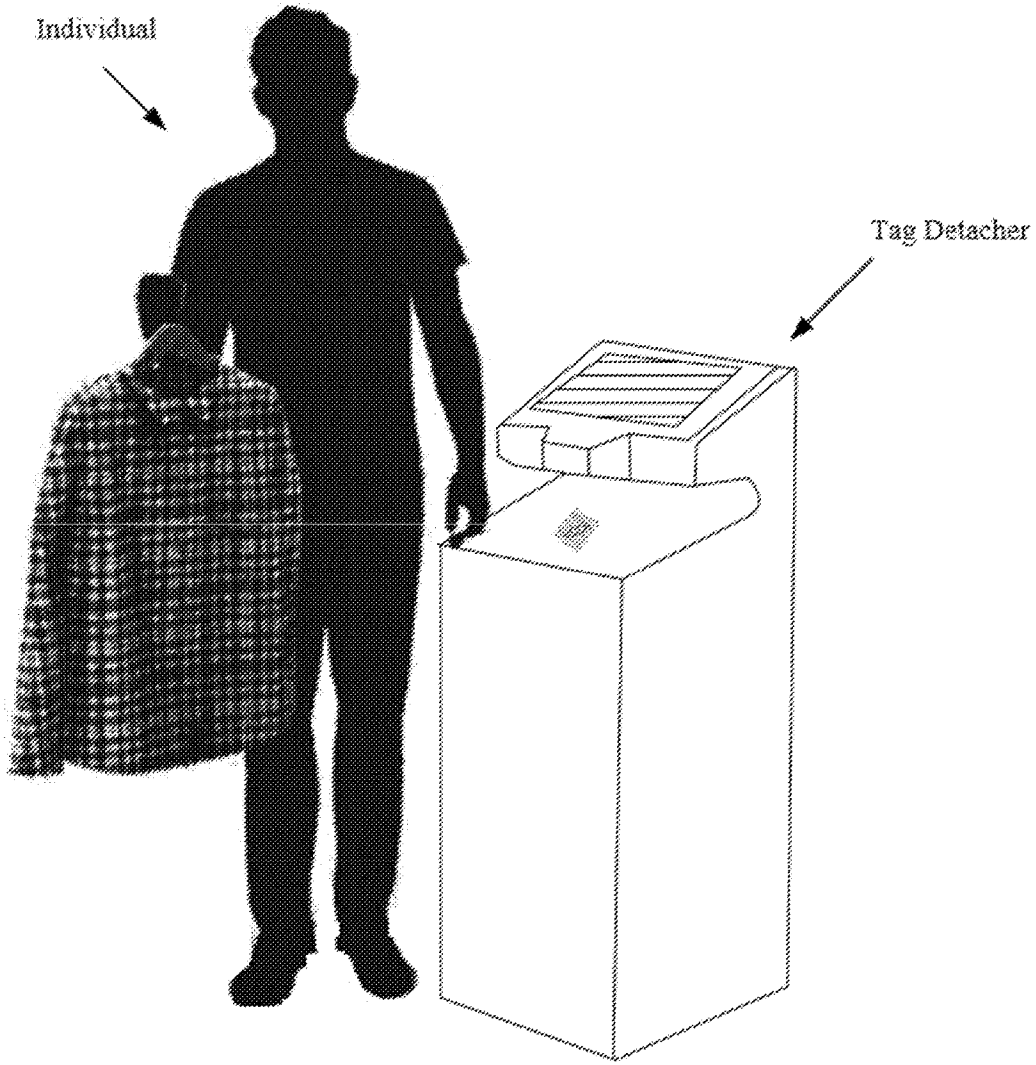
FIG. 16 provides an illustration showing a person in proximity to a tag detacher.
Figure 23:
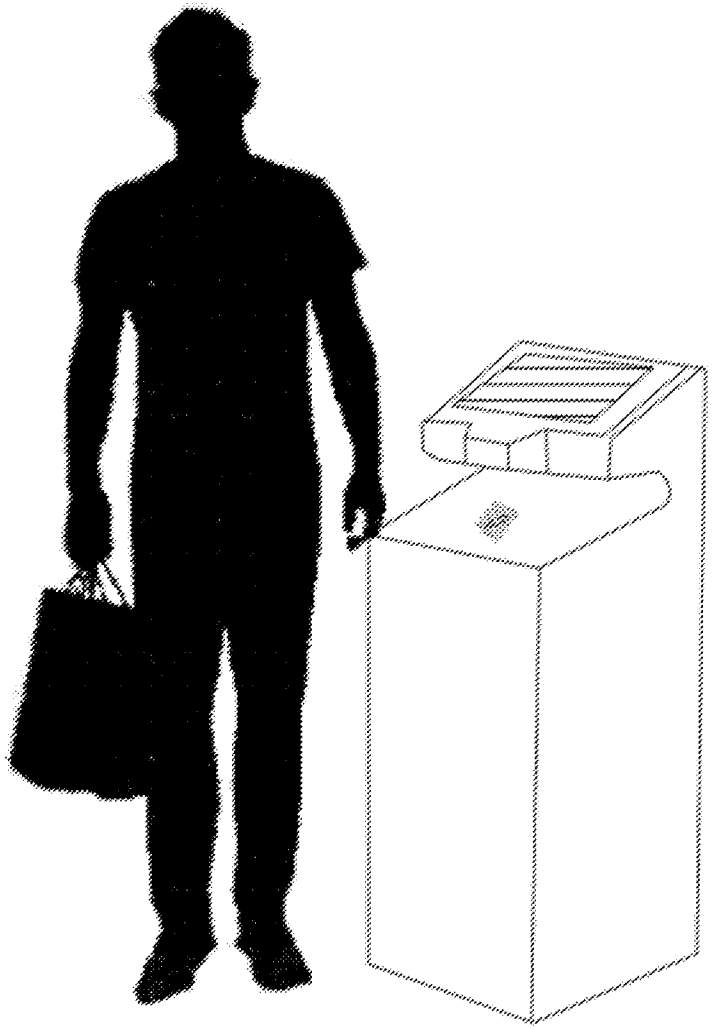
FIG. 23 provides an illustration showing a person who has completed a tag detaching process using the tag detacher of FIG. 16.

As shown in FIGS. 10-13, the tag detacher 1000 comprises a housing 1002 that houses a detaching unit 1004, a display 1006 (e.g., a touch screen display), a capturing unit 1008, and one or more sensor(s) 1014. The housing 1002 can be formed of any suitable material, such as metal and/or plastic. The housing 1002 can have a kiosk type of design (shown in FIGS. 16 and 23) or a table top type of design (shown in FIGS. 10-13).

The detaching unit 1004 is configured to detach a security tag (e.g., security tag 132 of FIG. 1) from an article (e.g., article 102 of FIG. 1). Detaching units are well known in the art, and therefore will not be described in detail herein. Any known or to be known detaching unit can be used herein with or without certain modifications made thereto (e.g., a novel pivotable nest 1010 as described herein). In some scenarios, the detaching unit includes, but is not limited to, a mechanical detacher having a part number DM1000 which is available from Sensormatic by Johnson Controls.

The one or more sensors 1014 are provided to facilitate the detachment of a security tag from the article. The sensor(s) 1014 can include, but is(are) not limited to, a camera, a thermal imaging sensor, an infrared sensor, a proximity sensor, a switch, a pressure sensor, and/or a beam break sensor. During operations, the sensor(s) generate(s) sensor data that is useful to (1) determine whether the security tag is properly placed in the nest 1010, (2) confirm that the security tag has been latched or otherwise coupled to the tag detacher, (3) determine whether an object is obstructing or otherwise blocking free and/or clear access to a tack head (e.g., tack head 210 of FIG. 2 and/or 802 of FIG. 8), (4) determine whether the article has been removed from the tag detacher 1000 after tag detachment, (5) determine whether at least a portion of the nest has pivoted or otherwise rotated by a certain amount, (6) determine whether the tag body (e.g., tag body 202 of FIG. 2) has slid or fallen out of the nest, and/or (7) determine whether the tag body and/or tack assembly has been placed on a storage container.

The sensor data may be used as feedback information for a machine learning algorithm/function of the tag detacher 1000. For example, the feedback information is used to train and/or optimize a machine learned model (e.g., a detection model for detecting or predicting when security tag is properly placed in the nest 1010, an object is obstructing or otherwise blocking free and/or clear access to a tack head, and/or the article has been removed from the tag detacher 1000) based on ongoing data gathering and analysis (e.g., for detecting when a user should be prompted for certain information, detecting when a detaching processing should be initiated, when a shield 1100 should be lowered or raised, when the detaching unit should be energized and/or de-energized, etc.)). The present solution is not limited in this regard.

The capturing unit 1008 is provided to facilitate the capturing of a tack assembly (e.g., tack assembly 204 of FIG. 2, 800 of FIG. 8 and/or 900 of FIG. 9) after being released from a securement mechanism (e.g., securement mechanism 406 of FIG. 4 and/or 706 of FIG. 7) inside the tag body (e.g., tag body 202 of FIG. 2). The capturing unit 1008 may be employed when the tack assembly is not integrated with or otherwise coupled to (e.g., via a lanyard) the tag body (e.g., tag body 202 of FIG. 2). The capturing unit 1008 can include, but is not limited to, a magnetic system, a vacuum system, a mechanical system (e.g., a telescoping arm with a gripper and/or magnet on a free end thereof, or an articulating arm with a gripper and/or magnet on a free end thereof), an electro-mechanical system (e.g., a computing device controlling a telescoping arm or other linkage). Magnetic and vacuum systems are well known in the art, and therefore will not be described herein.

In some scenarios, the capturing unit 1008 has a static or fixed position, as well as a gripper, magnet and/or vacuum chamber with a central axis 1022 that is aligned with a central axis of an aperture 1108 formed in a shield 1100 and/or a central axis of a tack assembly coupled to a tag body disposed in the nest 1010. In other scenarios, at least a portion of the capturing unit 1008 with the gripper, magnet and/or vacuum chamber is transitionable between a retracted position in which it resides in proximity to or in the tag detacher housing 1002 (i.e., the central axis 1022 is not aligned with the central axis of aperture 1108 and/or the central axis of the tack assembly) and an extended position in which it is extended out and away from the tag detacher housing 1002 (i.e., the central axis 1022 is aligned with the central axis of an aperture 1108 and/or the central axis of a tack assembly). According, the capturing unit 1008 may be configured to be at least partially moved in and out of the tag detacher housing 1002. This movement of the capturing unit 1008 can be facilitated by a track, a linkage, a motor, and/or gears.

A support structure 1012 may be provided with the tag detacher 1000. The support structure 1012 structurally supports an article while the security tag is being detached therefrom. The support structure 1012 has a generally planar profile, and is mechanically coupled to the housing 1002 via couplers (e.g., screws, bolts, brackets, etc.) so as to protrude out and away from the housing 1002. The support structure 1012 can be formed of any suitable material, such as metal or plastic.

A shield 1100 is provided to facilitate retention of the article and security tag in a given position relative to the detaching unit 1004 during a tag detaching process. Accordingly, the shield 1100 is transitionable from an unengaged position shown in FIG. 10 to an engaged position shown in FIG. 11. In the unengaged position, the shield 1100 resides adjacent to the capturing unit 1008. In the engaged position, the shield 1100 resides adjacent to the detaching unit 1004. This transition of the shield's position can be achieved using a shield mover 1002. Shield mover 1002 can include, but is not limited to, tracks that can lower and raise the shield as shown by arrows 1004, 1006 in FIG. 11), and/or automated hinges that can cause pivotal movement of the shield relative to the detaching unit 1004 (not shown). A space 1016 is provided in the housing 1002 that is sized and shaped to allow the lowering/raising/pivoting/rotating movement of the shield 1100, in addition to the insertion of the tag in the nest 1010. Notably, the shield 1100 has an aperture 1108 formed therein. The aperture 1108 is sized and shaped to allow unobstructed access to the tack assembly by the capturing unit 1008. The shield 1100 is formed of any suitable material, such as metal and plastic.

Figure 14A:
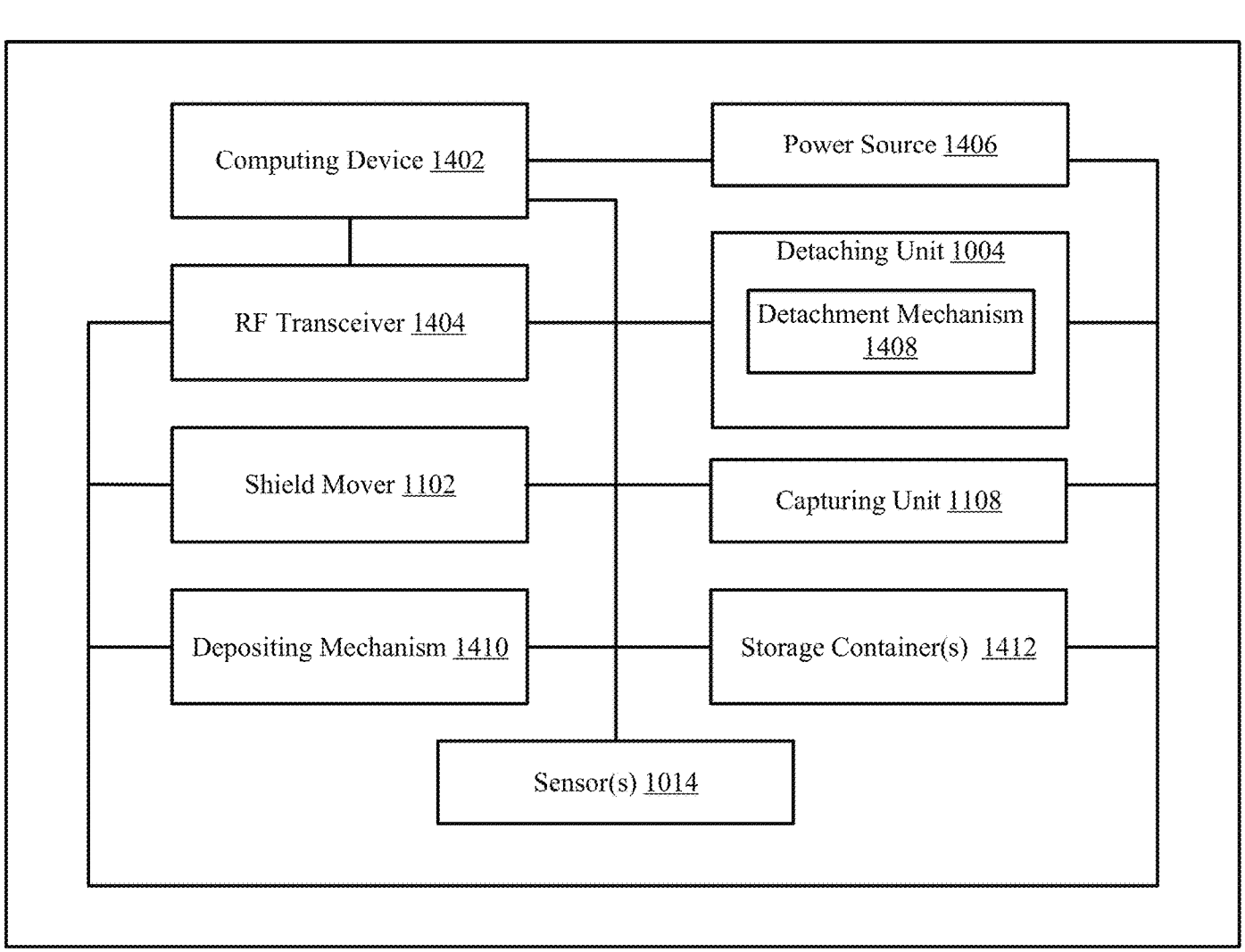
FIGS. 14A-14B (collectively referred to as "FIG. 14") provide illustrations of illustrative internal components of the tag detacher.

The internal components of the tag detacher 1000 will now be described in relation to FIG. 14. As shown in FIG. 14A, the tag detacher 1000 comprises a computing device 1402, an RF transceiver 1404, a power source 1406 (e.g., AC mains, battery, capacitor, and/or energy harvesting circuit), and a detaching unit 1004 with a detachment mechanism 1408 (e.g., an arcuate probe (e.g., probe 302 of FIG. 2) or magnetic field source such as a coil). RF transceivers, power sources and detachment mechanisms are well known in the art, and therefore will not be described in detail herein. Still, it should be noted that the computing device 1402 controls the RF transceiver 1404 and power source 1406 for performing all or some of the above-described methods for verifying a detachment of a security tag (e.g., security tag 132 of FIG. 1) from an article.

The tag detacher 1000 also comprises a depositing mechanism 1410 for depositing a tag body and/or a tack assembly in storage container(s) 1412. With regard to the tag body, the depositing mechanism 1410 can include, but is not limited to, an electro-mechanical system (e.g., a motor, gears, and/or a linkage) configured to rotate or pivot the nest 1010 relative to the tag detacher housing 1002 so that at least the tag body is allowed to fall, slide or be ejected into a storage container 1412, and/or an electro-mechanical system configured to rotate or swivel the detaching unit 1004 relative to the housing 1002 so that a bottom wall of the nest 1020 is moved away whereby at least the tag body is allowed to fall, slide or be ejected into a storage container 1412. With regard to a tack assembly which is not integrated with or coupled to the tag body, the depositing mechanism 1410 can include, but is not limited to, an electromechanical system configured to retract the capturing unit 1108 into the housing 1002 and cause the release of the tack assembly from the capturing unit 1108.

The storage container(s) 1412 comprise(s) any structure which is suitable for storing tag bodies and/or tacks. Such structures include, but are not limited to, bins, boxes, buckets and/or baskets. The storage container(s) 1412 can be formed of various materials, such as metal, plastic and card board. The tag bodies and tacks can be stored in the same or different storage container. As such, two or more storage containers 1412 can be provided with the tag detacher 1000. Each storage container 1416 is sized and shaped to fit within a container space provided inside the tag detacher 1000. The container space can be provided on at least a portion of a shelf.

Figure 14B:
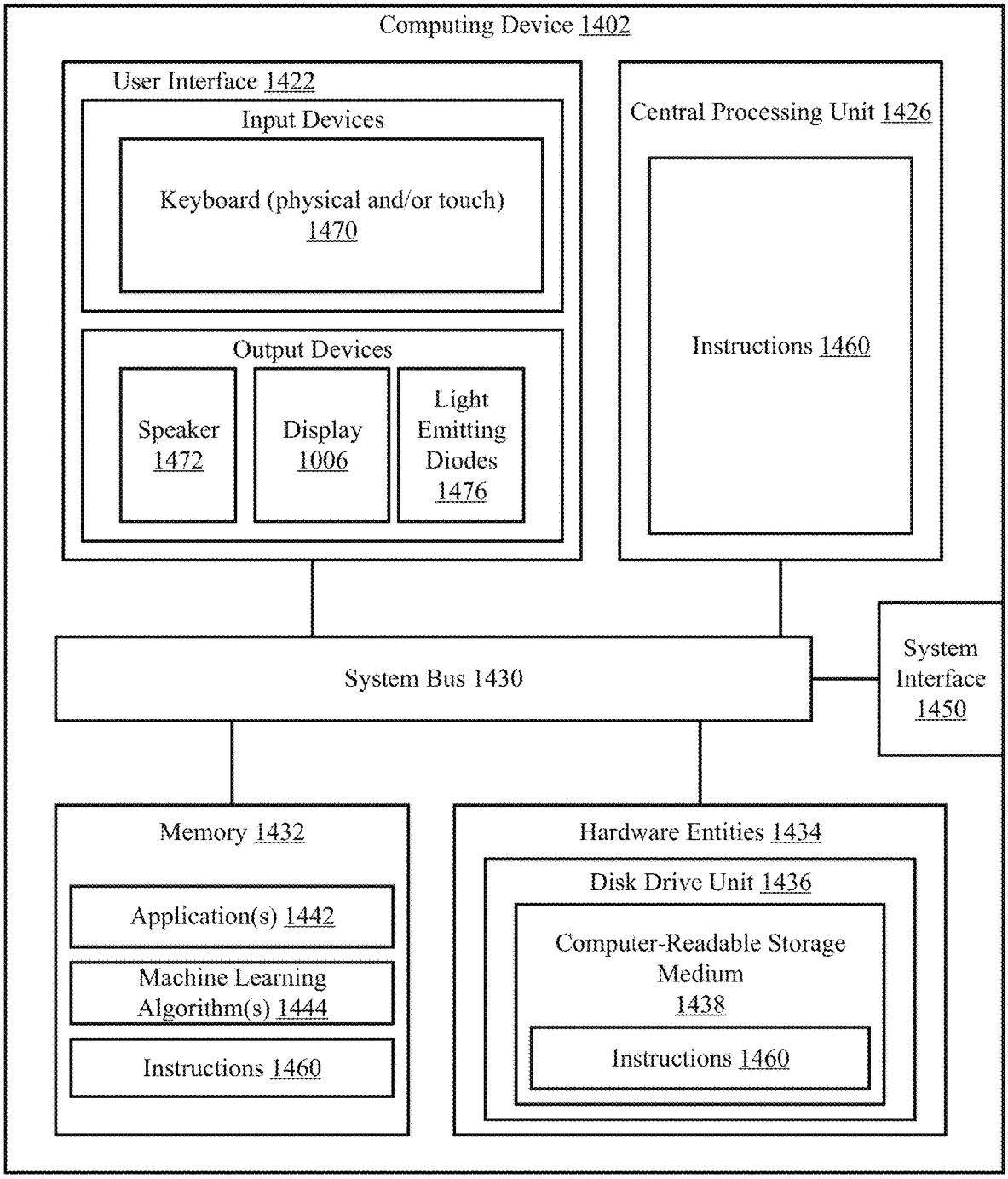

Referring now to FIG. 14B, there is provided an illustration of an illustrative architecture for a computing device 1402. In some scenarios, the present solution is used in a client-server architecture. Accordingly, the computing device architecture shown in FIG. 14B is sufficient for understanding the particulars of client computing devices and servers.

Computing device 1402 may include more or less components than those shown in FIG. 14B. However, the components shown are sufficient to disclose an illustrative solution implementing the present solution. The hardware architecture of FIG. 14B represents one implementation of a representative computing device configured to provide an improved tag detachment process, as described herein. As such, the computing device 1402 of FIG. 14B implements at least a portion of the method(s) described herein.

Some or all components of the computing device 1402 can be implemented as hardware, software and/or a combination of hardware and software. The hardware includes, but is not limited to, one or more electronic circuits. The electronic circuits can include, but are not limited to, passive components (e.g., resistors and capacitors) and/or active components (e.g., amplifiers and/or microprocessors). The passive and/or active components can be adapted to, arranged to and/or programmed to perform one or more of the methodologies, procedures, or functions described herein.

As shown in FIG. 14B, the computing device 1402 comprises a user interface 1422, a Central Processing Unit ("CPU") 1426, a system bus 1430, a memory 1432 connected to and accessible by other portions of computing device 1402 through system bus 1430, a system interface 1450, and hardware entities 1434 connected to system bus 1430. The user interface can include input devices and output devices, which facilitate user-software interactions for controlling operations of the computing device 1402. The input devices include, but are not limited, a physical and/or touch keyboard 1470. The input devices can be connected to the computing device 1402 via a wired or wireless connection (e.g., a Bluetooth® connection). The output devices include, but are not limited to, a speaker 1472, a display 1006, and/or light emitting diodes 1476. System interface 1450 is configured to facilitate wired or wireless communications to and from external devices (e.g., network nodes such as access points, POS system, etc.).

At least some of the hardware entities 1434 perform actions involving access to and use of memory 1432, which can be a Radom Access Memory ("RAM"), a disk driver and/or a Compact Disc Read Only Memory ("CD-ROM"). Hardware entities 1434 can include a disk drive unit 1436 comprising a computer-readable storage medium 1438 on which is stored one or more sets of instructions 1460 (e.g., software code) configured to implement one or more of the methodologies, procedures, or functions described herein. The instructions 1460 can also reside, completely or at least partially, within the memory 1432 and/or within the CPU 1426 during execution thereof by the computing device 1402. The memory 1432 and the CPU 1426 also can constitute machine-readable media. The term "machine-readable media", as used here, refers to a single medium or multiple media (e.g., a centralized or distributed database, and/or associated caches and servers) that store the one or more sets of instructions 1460. The term "machine-readable media", as used here, also refers to any medium that is capable of storing, encoding or carrying a set of instructions 1460 for execution by the computing device 1402 and that cause the computing device 1402 to perform any one or more of the methodologies of the present disclosure.

In some scenarios, the hardware entities 1434 include an electronic circuit (e.g., a processor) programmed for facilitating tag detachment from articles. In this regard, it should be understood that the electronic circuit can access and run an application 1442 and/or a machine learning application 1444 installed on the computing device 1402.

Figure 10:
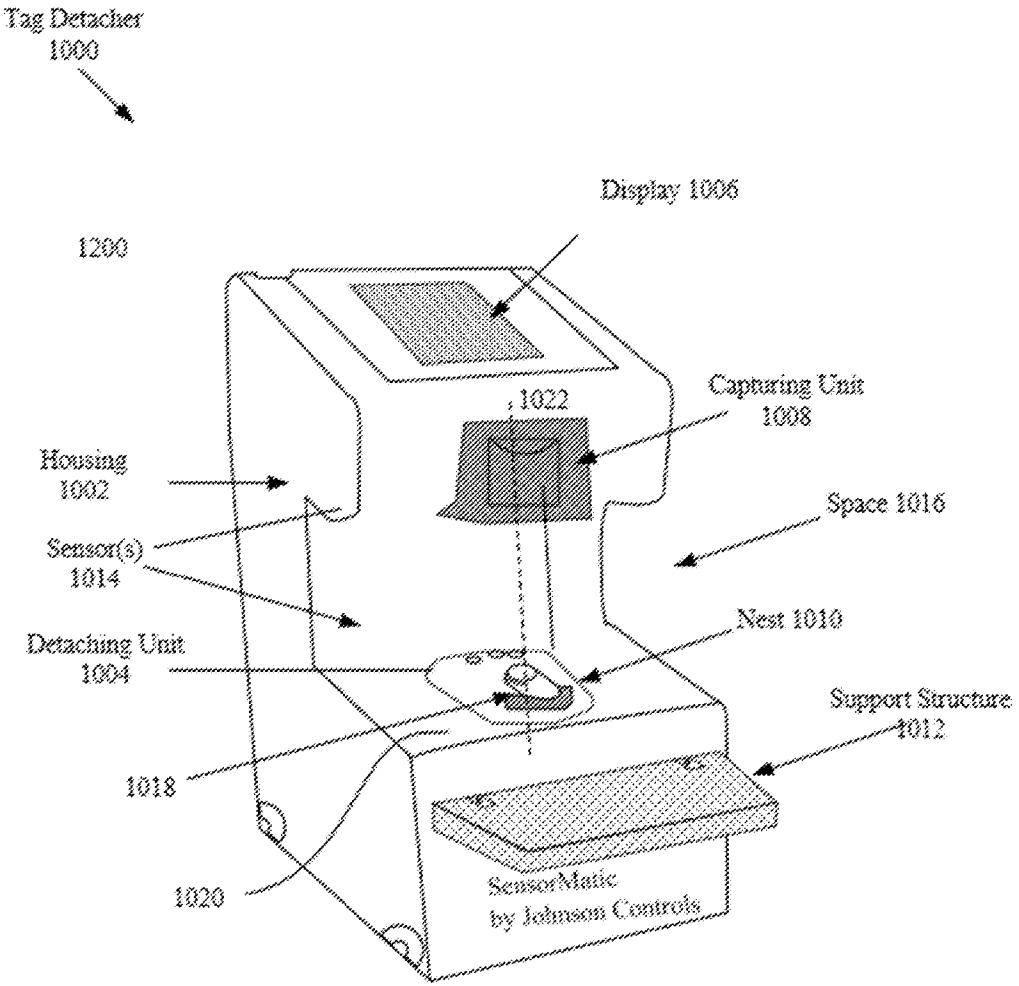
FIGS. 10 and 11 each provide a perspective view of an illustrative tag detacher.
Figure 11:
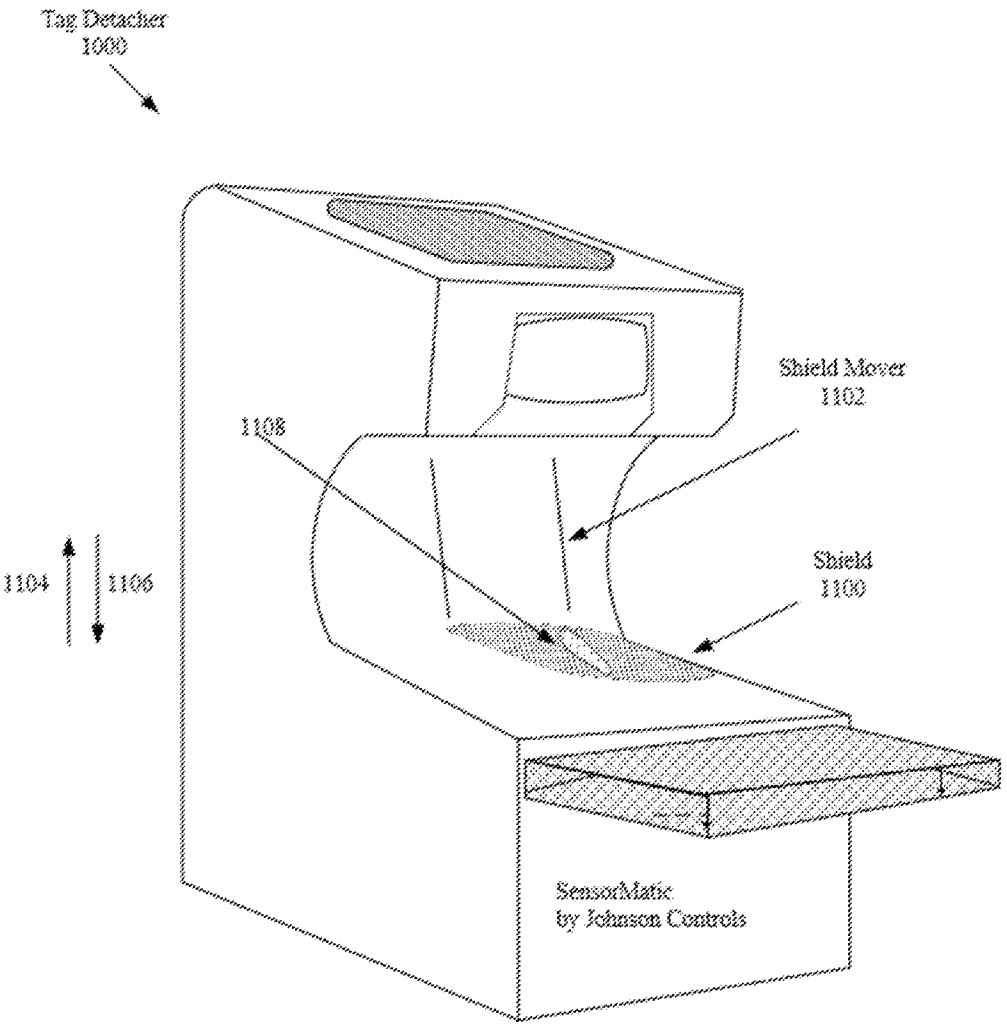
Figure 13:
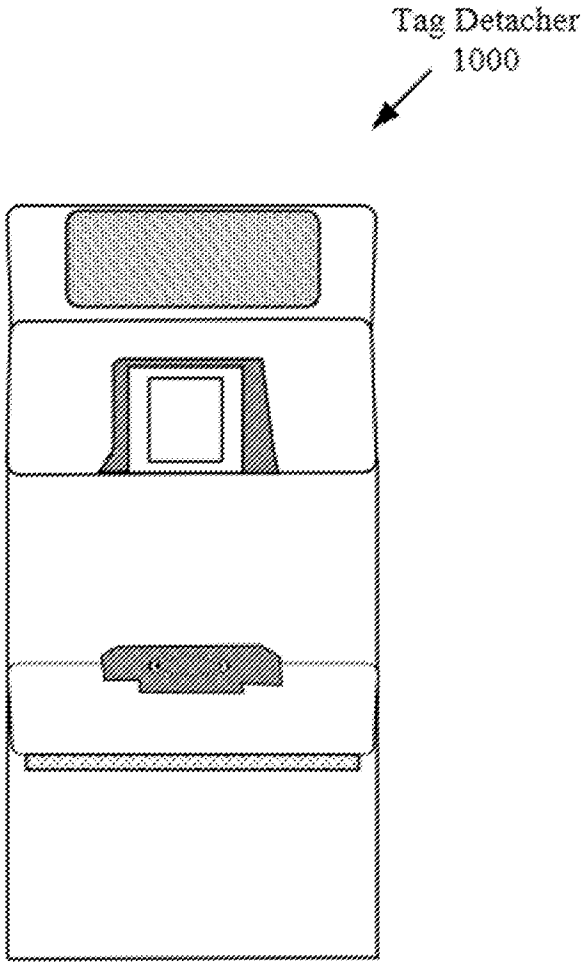
FIG. 13 provides a front view of the tag detacher shown in FIGS. 10-11.
Figure 12:
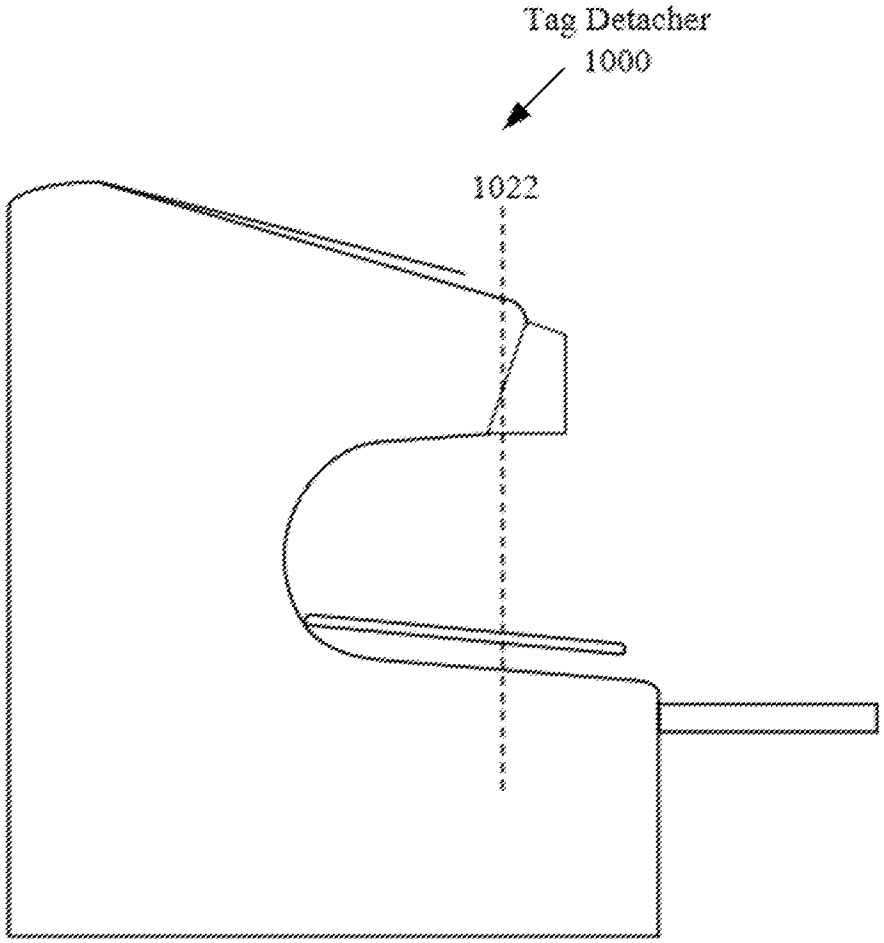
FIG. 12 provides a side view of the tag detacher shown in FIGS. 10-11.

The application 1442 receives and processes sensor data (e.g., images) generated by sensor(s) (e.g., sensor(s) 1014 of FIG. 10). In some scenarios, the sensor(s) comprise a camera that monitors and captures images of space 1016, detaching unit 1004, nest 1010 and/or shield 1100 of the tag detacher 1000. The application 1442 also performs real time sensor data analytics. In this regard, application 1442 employs real time sensor data analytics algorithms. The real time sensor data analytics algorithms process sensor data (e.g., images) to detect articles (e.g., article 102 of FIG. 1) in space 1016 of tag detacher 1000, detect the presence of security tags (e.g., security tag 132 of FIG. 1) in nest 1010, detect positions of the security tags in the nest 1010, detect latching of the security tag in the nest, detect any objects obstruction or blocking free and clear access to tack assemblies, and/or detect removal of articles from the space 1016. The real time sensor data analytics algorithms can also be used to predict whether a successful security tag detachment will occur in view of a current tag body position in the nest, a current arrangement of an article coupled to the security tag, and/or current locations of objects relative to a tack assembly. The detections and/or predictions can be made using pre-trained machine learned models. The detected information can then be used as feedback information for further training the machine learned models so as to optimize the same. In some scenarios, a detachment mechanism of the tag detacher is energized based on the detections and/or predictions (e.g., when a prediction is made that the security tag will be successfully detached from the article in view of the real time sensor data analytics).

The machine learning application 1444 implements Artificial Intelligence ("AI") that provides the computing device 1402 with the ability to automatically learn and improve data analytics from experience without being explicitly programmed. The machine learning application 1444 employs one or more machine learning algorithms that learn various information from accessed data (e.g., via pattern recognition and prediction making using one or more machine learned models which are pre-trained and/or re-trained/optimized based on ongoing data gathering and analysis). Machine learning algorithms are well known in the art, and therefore will not be described herein in detail. Any known or to be known machine learning algorithm can be used herein without limitation. For example, in some scenarios, the machine learning application 1444 employs a supervised learning algorithm, an unsupervised learning algorithm, and/or a semi-supervised learning algorithm. The learning algorithm(s) is(are) used to model inventory decisions based on data analysis (e.g., captured images, article identifiers (e.g., UPCs), POS transaction information, and other information).

For example, the learning algorithm(s) is(are) configured to generate recommendations to actuate a shield, recommendations to energize the detaching unit 1004, and/or predictions about whether a tag detachment process will be successful. The present solution is not limited to the particulars of this example.

The machine learning algorithms and models may be trained offline with all products in a facility (e.g., facility 150 of FIG. 1). This offline training provides pre-trained machine learned models. The pre-trained machine learned models are used to detect and classify objects that are sold or rented from the facility. The machine learning algorithms and models may additionally or alternatively be trained online based on ongoing data gathering and analysis. This online machine learning has certain advantages such as ensuring that the optimized machine learning algorithms and models are used for tag detachment purposes, which results in an inventory management system with improved analytics and/or an improved tag detachment system in which operations/predictions/recommendations are made based on results of the improved analytics.

The software applications 1442 is generally operative to: obtain article level information and/or other information (e.g., from security tags 132 of FIG. 1) coupled to articles (e.g., articles 102 of FIG. 1); obtain timestamped sale transaction information from POS devices and/or RTSs (e.g., RTS 118 of FIG. 1); obtain sensor data (e.g., images) generated by at least sensor (e.g., sensor(s) 1014 of FIG. 10); monitor activities in an area (e.g., space 1016 of FIG. 10) in the FOV of the sensor(s); process the sensor data to produce timestamped real time video analytics information identifying articles and/or security tags disposed on the tag detacher 1000; store timestamped sale transaction information, sensor data (e.g., the images) and/or the timestamped real time sensor data analytics information in a datastore (e.g., memory 1432 of FIG. 14B or remote datastore); use the time stamped POS information and timestamped real time sensor data analytics information for machine learning purposes; generate alerts, prompts and/or notifications when certain conditions/states of article(s), security tag(s), tag body(ies) and/or tack assembly(ies) is(are) detected (e.g., the alert/prompt/notification comprising an indication that a tag body is not properly placed in a nest and/or that an object is obstructing/blocking access to a tack assembly); cause alerts and/or notifications to be output; and/or reset data upon completion of tag detachment process (e.g., when that tag body and/or tack assembly of a security tag has(have) been deposited in a container, and/or when a shield has been transitioned to its unengaged position). Other functions of the software applications 1142, 1444 will become apparent as the discussion progresses.

Referring now to FIG. 15, there is provided a flow diagram of an illustrative method 1500 for security device detachment. Method 1500 comprises various operations 1504-1558. The order of some of these operations can be different than that shown in FIG. 15. Also, method 1500 can include more or less operations than that shown in FIG. 15.

Figure 15A:
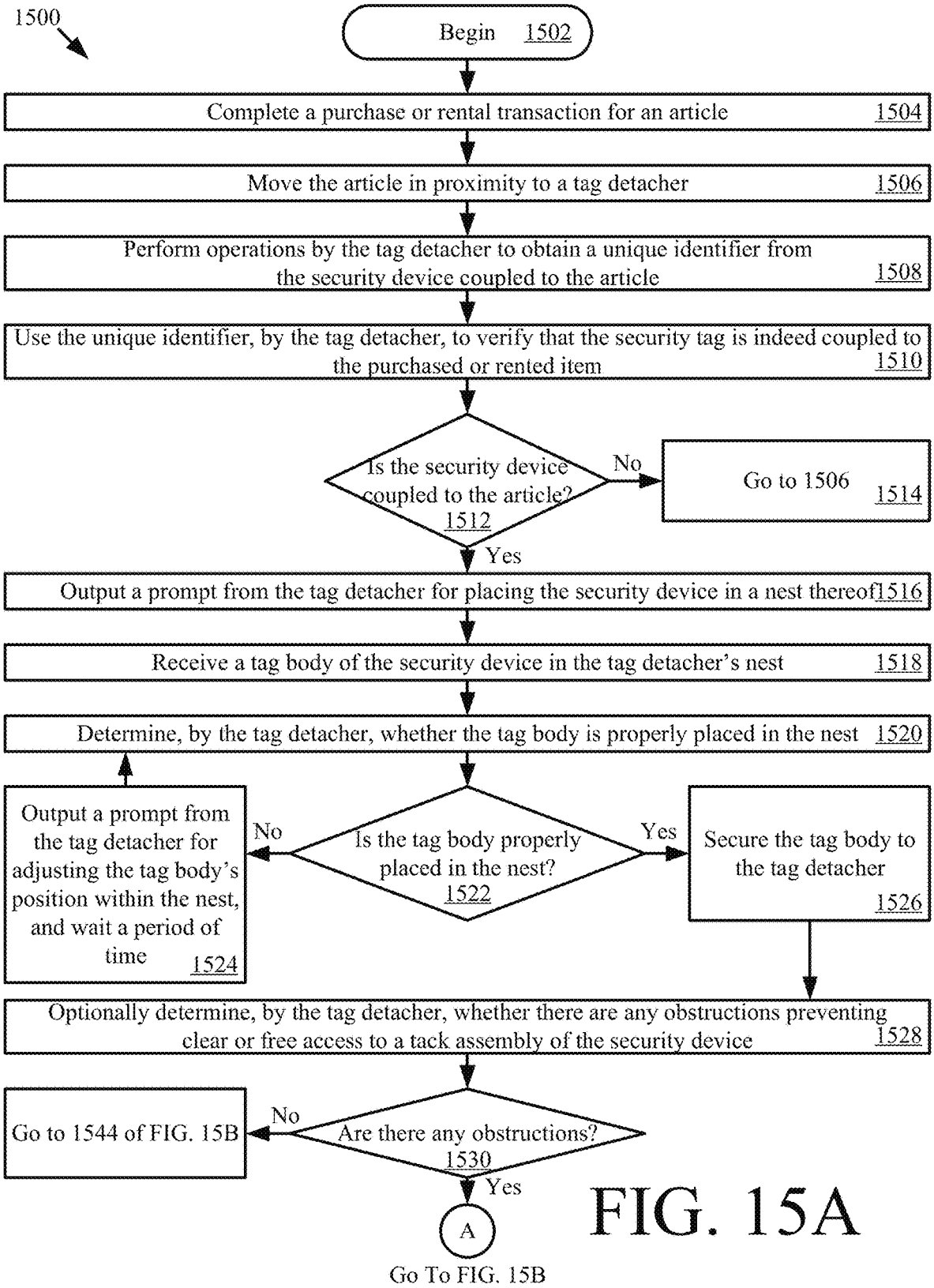
FIGS. 15A-15B (collectively referred to herein as "FIG. 15") provides a flow diagram of an illustrative method for security device detachment.

As shown in FIG. 15A, method 1500 begins with 1502 and continues with 1504 where a purchase transaction for an article (e.g., article 102 of FIG. 1) is completed. Methods for performing purchase transactions are well known in the art, and therefore will not be described herein. Any known or to be known purchase transaction method can be used herein without limitation. Next in 1506, the article is moved in proximity to a tag detacher (e.g., tag detacher 1000 of FIGS. 10-14). An illustration showing an individual (e.g., individual 140 of FIG. 1) standing next to a tag detacher (e.g., tag detacher 190 of FIG. 1) with a purchased article (e.g., article 102 of FIG. 1) is provided in FIG. 16.

In 1508, the tag detacher performs operations to obtain a unique identifier (e.g., an EPC) from the security device (e.g., security tag 132 of FIG. 1) that is coupled to the article. The unique identifier can be obtained via wireless communications (e.g., RFID communications or barcode communication) between the tag detacher and the security device, as is known in the art. The tag detacher processes the unique identifier to determine whether the security device is coupled to the purchased article or another unpurchased article. This determination can be made by comparing the unique identifier to those listed in POS transaction data associated with a given purchase transaction. If the unique identifier matches one listed in the POS transaction data and/or an appearance of the article matches (by a certain degree) a described appearance of a purchased article, then a determination is made that the security device is indeed coupled to the purchased article. Otherwise, a determination is made that the security device is coupled to an article other than the purchased article. If the security device is not coupled to the purchased article, then method 1500 goes to 1506, as shown by 1514.

Figure 17:
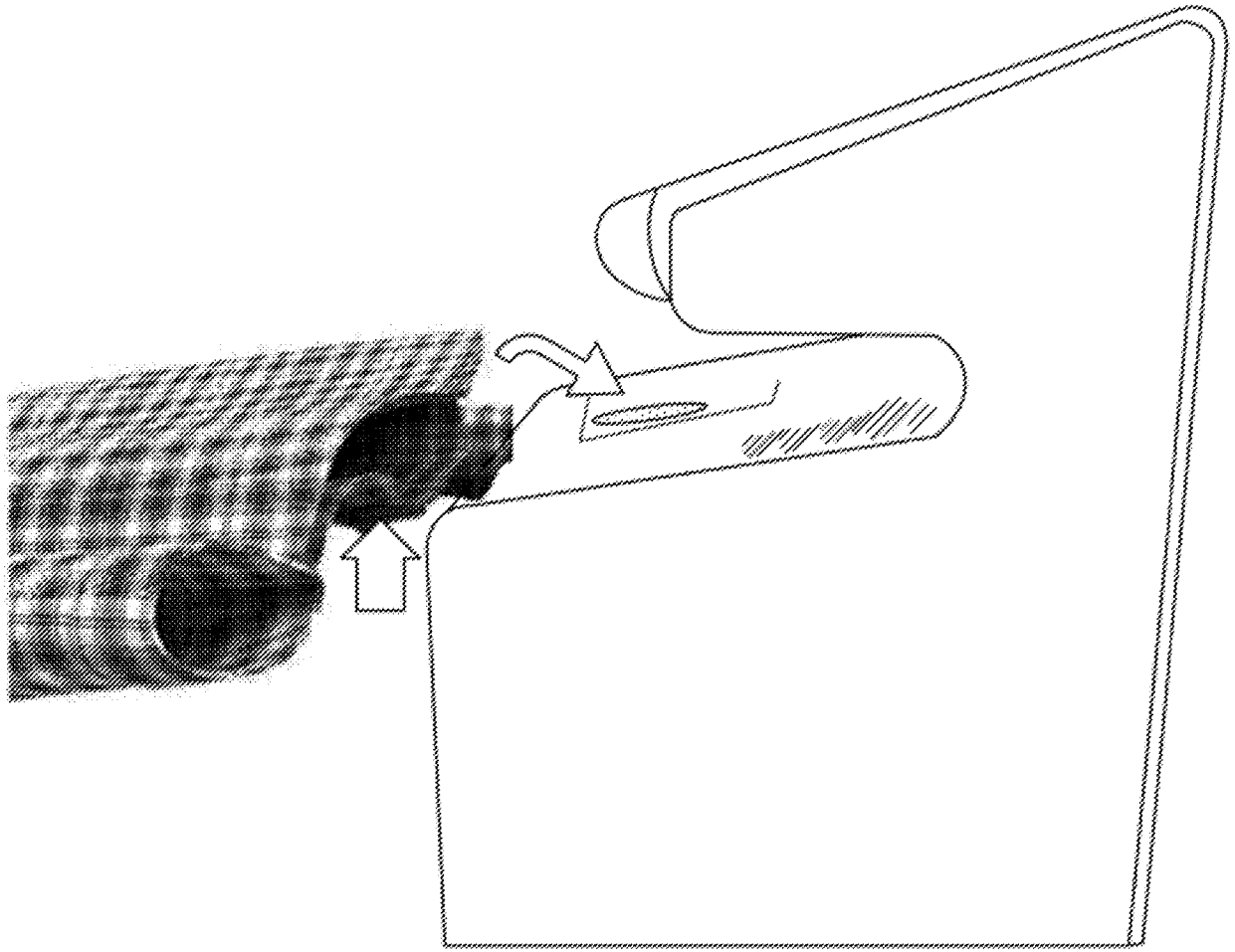
FIG. 17 provides an illustration showing an article being inserted into an insert space of the tag detacher of FIG. 16.
Figure 18A:
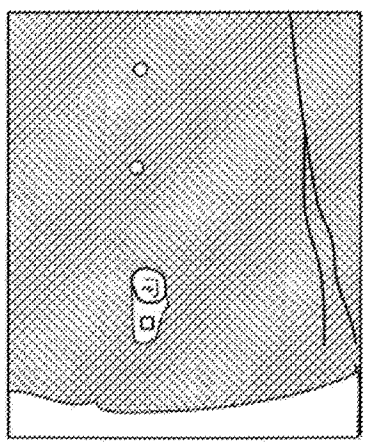
FIGS. 18A-18E (collectively referred to herein as "FIG. 18") provide illustrations showing a security tag of an article being placed in a nest of tag detacher.
Figure 18B:
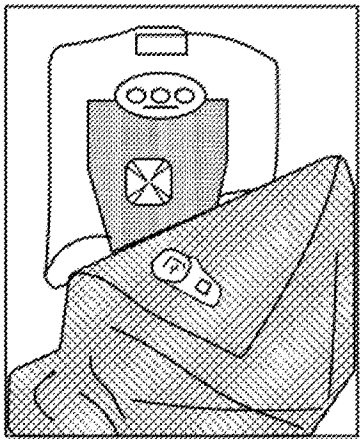
Figure 18C:
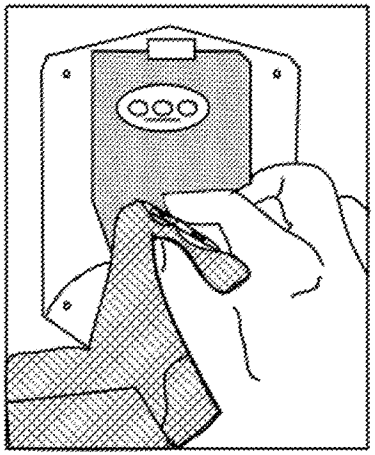
Figure 18D:
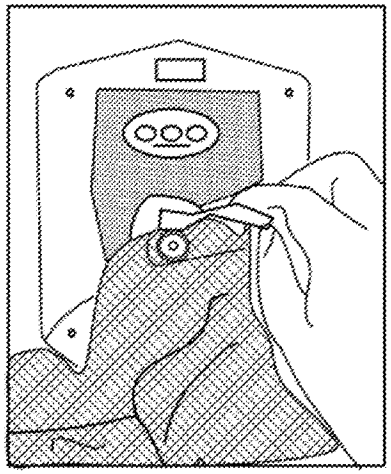
Figure 18E:
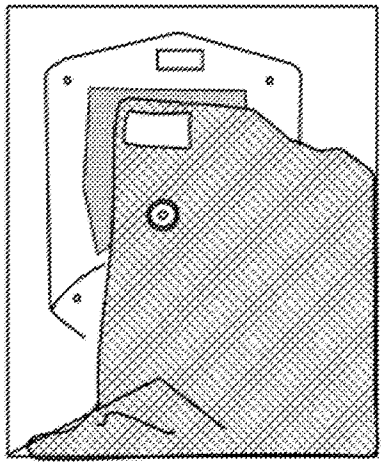

In contrast, if the security device is coupled to the purchased article, then 1516-1518 are performed. 1516-1518 involve: outputting a prompt from the tag detacher for placing the security device in a nest (e.g., nest 1010 of FIG. 10) thereof; and receiving a tag body (e.g., tag body 202 of FIG. 2) in the tag detacher's nest. An illustration showing an article being inserted in an insert space (e.g., space 1016 of FIG. 10) of the tag detacher is provided in FIG. 17. Illustrations are provided in FIGS. 18A-18E that show a security device coupled to the article of FIG. 17 being placed in a nest of a tag detacher.

In 1520, the tag detacher performs operations to determine whether the tag body is properly placed in the nest. These operations can include, but are not limited to, obtaining sensor data generated by at least one sensor (e.g., sensor(s) 1014 of FIG. 10) of the tag detacher, and analyzing the sensor data (e.g., images, switch position states (i.e., open or closed), etc.) to detect whether the tag body is properly placed in the nest. This analysis can be achieved using a machine learning algorithm (e.g., machine learning algorithm(s) 1444 of FIG. 14B) and/or a machine learned model.

If the tag body is not properly placed in the nest [1522: NO], then 1524 is performed where the tag detacher outputs a prompt (e.g., via display 1006 of FIG. 10) for adjusting the tag body's position within the nest. The tag detacher also waits a period of time before returning to 1520. This amount of time is chosen to be a maximum or reasonable amount of time that it takes an individual to adjust the tag body's position in a nest. This amount of time can be pre-stored or machine learned using feedback sensor data over a given time period and/or a given number of tag detachment processes.

If the tag body is properly placed in the nest [1522:YES], then 1526 is performed where the tag body is secured to the tag detacher. The tag body can be secured to the tag detacher using a latch mechanism (e.g., latch mechanism 1018 of FIG. 10). The latch mechanism can include, but is not limited to, a movable bar or post that can extended from the tag detacher and retracted into the tag detacher. When the bar or post is in an extended position (as shown in FIG. 10), it engages the tag body so as to prevent removal of the tag body from the nest. When the bar or post is in the retracted position, it does not engage the tag body such that the tag body can be freely moved into, within and out of the nest.

Upon completing 1526, 1528 may optionally be performed. In 1528, the tag detacher determines whether there are any obstructions preventing clear or free access to the tack assembly (e.g., tack assembly 204 of FIG. 2, 800 of FIG. 8, or 900 of FIG. 9) of the security device. This determination can be made using sensor data generated by one or more sensors (e.g., sensors 1014 of FIG. 10) of the tag detacher. For example, an image captured by a camera of the tag detacher can be analyzed (e.g., using a machine learned model) to detect any objects placed over or within a given distance of the tack assembly which might cause issues during a tag detachment process. The present solution is not limited to the particulars of this example.

Figure 15B:
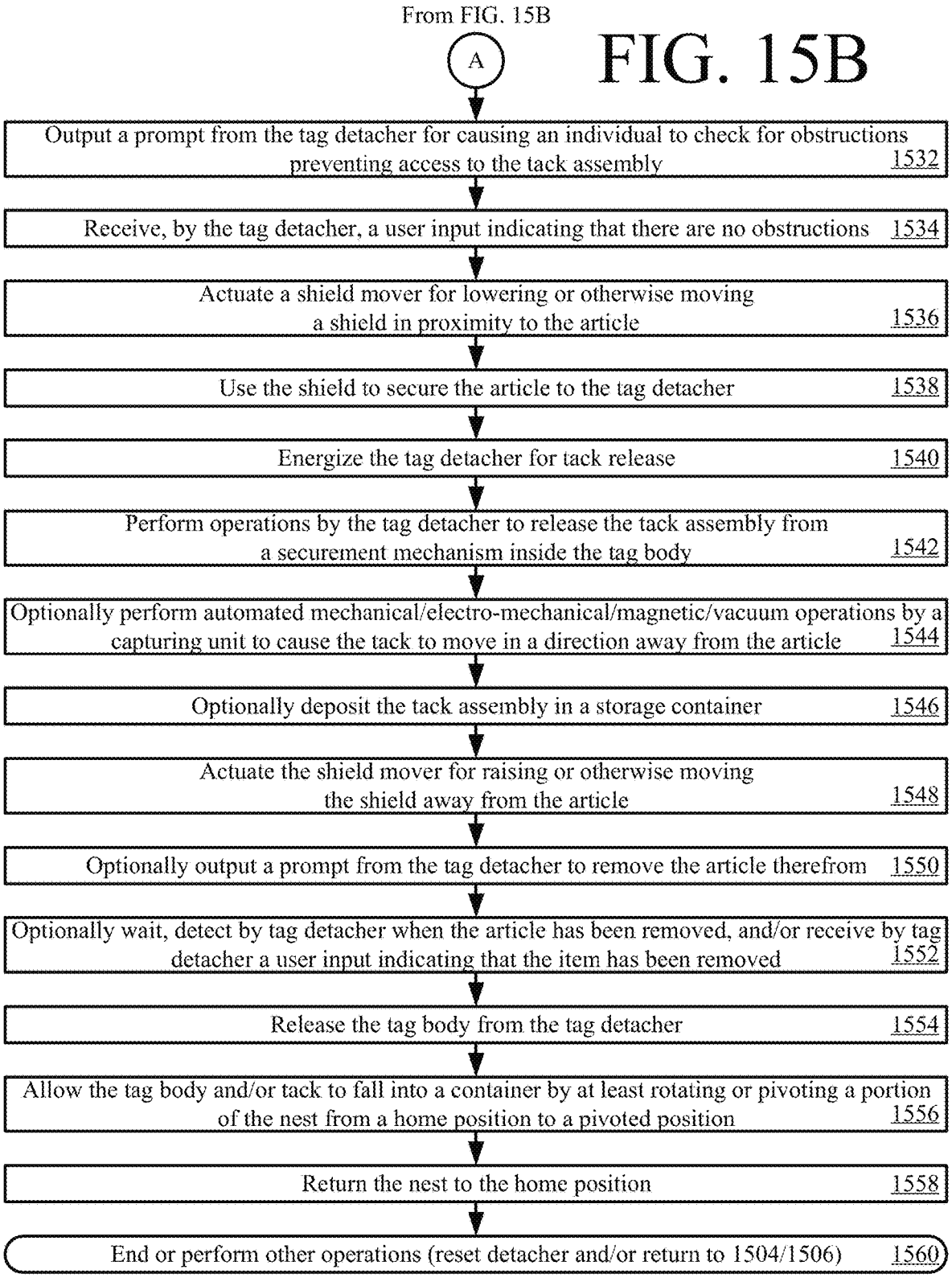

If there is not any obstruction [1530:NO], then method 1500 continues with 1544 of FIG. 15B, which will be described below. In contrast, if there is an obstruction [1530:YES], then method 1500 continues with 1532 of FIG. 15B. In 1532, the tag detacher outputs a prompt (e.g., via display 1006 of FIG. 10 and/or speaker 1472 of FIG. 14B) for causing the individual to check that there are no obstructions preventing clear and free access to the tack assembly. The tag detacher may receive a user input in 1534 indicating that there are no obstructions.

In 1536, a shield mover (e.g., shield mover 1102 of FIG. 11) is actuated for lowering or otherwise moving a shield (e.g., shield 1100 of FIG. 11) in proximity to the article. For example, the shield is lowered manually, using an automated mechanical track, or an automated rotatable/pivotable mechanism (e.g., automated hinges). The present solution is not limited to the particulars of this example. The shield is used to clamp or otherwise secure the article to the tag detacher (e.g., by clamping the article between the shield and a housing surface (e.g., surface 1020 of FIG. 10), as shown by 1538).

Next, the tag detacher is energized in 1540 for tack release. In 1542, the tag detacher performs operations to release the tack assembly from a securement mechanism (e.g., securement mechanism 406 of FIG. 4 and/or 706 of FIG. 7) inside the tag body.

Figure 19:
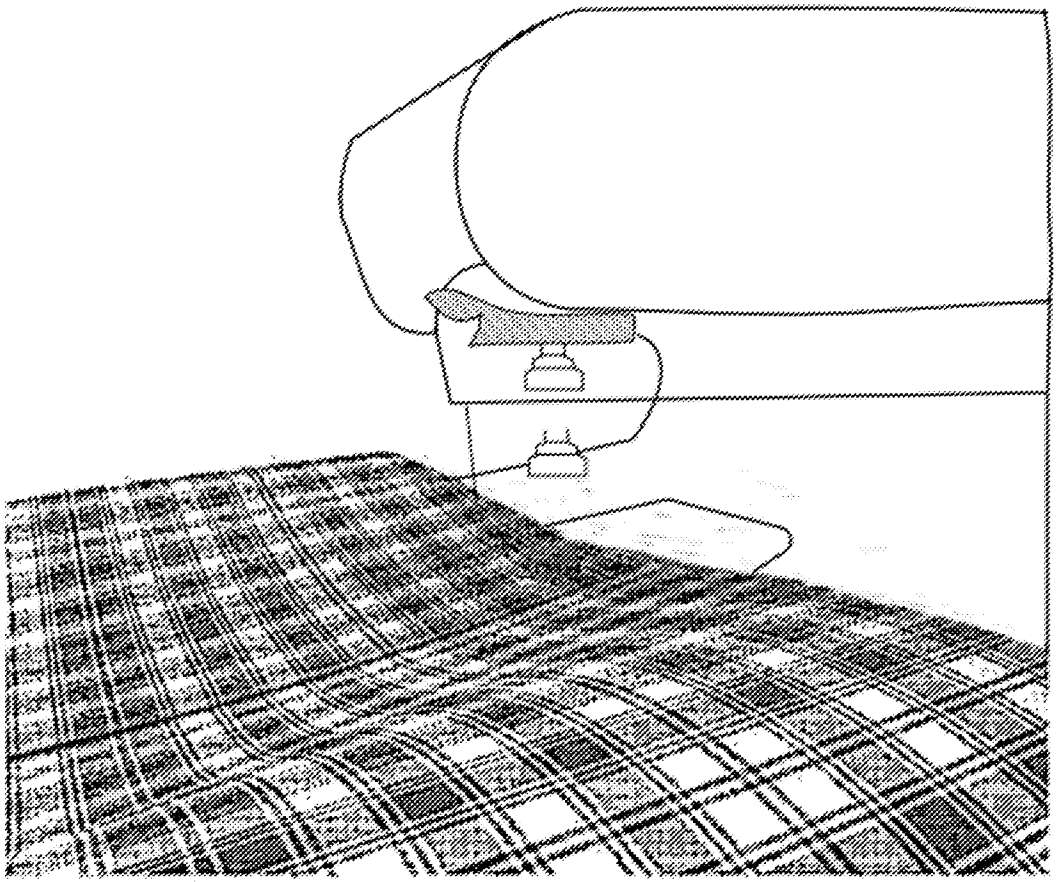
FIG. 19 provides an illustration of a tack being removed from the article and captured by the tag detacher.
Figure 20:
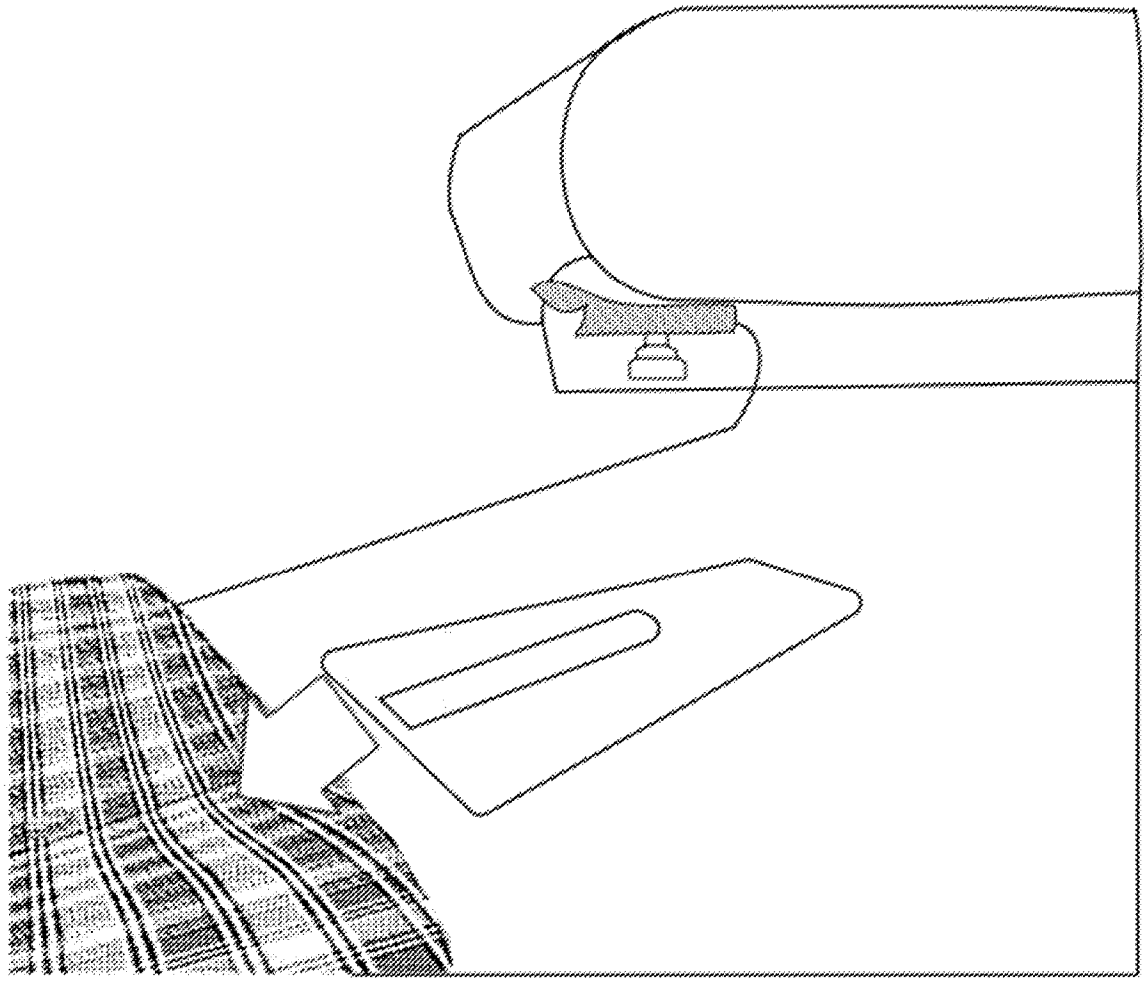
FIG. 20 provides an illustration of showing the article and tack being moved away from the tag detacher's nest.

In some scenarios, the tack assembly may be integrated with the tag body. However, in other scenarios, the tack assembly is a separate part from the tag body and is not coupled to the tag body. In the latter case, method 1500 can involve operations of 1544-1546. 1544-1546 involve: moving a capturing unit (e.g., capturing unit 1108 of FIG. 11) of the tag detacher over the tack assembly (e.g., by sliding the capturing unit in a direction out and away from the tag detacher); performing automated mechanical/electro-mechanical/magnetic/vacuum operations by the capturing unit of the tag detacher to cause the tack to move in a direction away from the article (e.g., in direction 1106 of FIG. 11); moving the capturing unit back to a rest position adjacent the tag detacher; and/or depositing the tack assembly in a storage container (e.g., storage container 1412 of FIG. 14A). An illustration showing the capturing unit located over a tack assembly is provided in FIG. 19. FIG. 19 also shows the capturing unit performing magnetic or vacuum operations so as to cause the tack to move in direction away from the article (e.g., a shirt). The magnetic or vacuum operations result in the capturing of the tack assembly by the capturing unit. An illustration showing the capturing unit being moved back to the rest position is provided in FIG. 20. When the capturing unit is in its rest position, the magnetic or vacuum operations are discontinued, whereby the tack assembly falls into the container being housed within the tag detacher.

In 1548, the shield mover is once again actuated for raising or otherwise moving the shield away from the item (i.e., from its engaged position to its unengaged position). Subsequently, method 1500 may continue with 1550-1552 or 1554. 1550-1552 involve: optionally outputting a prompt from the tag detacher to remove the article therefrom; and/or optionally wait, detect by the tag detacher when the article has been removed, and/or receive by the tag detacher a user input indicating that the article has been removed. An illustration showing the article being removed from the tag detacher is provided in FIG. 20.

Figure 21:
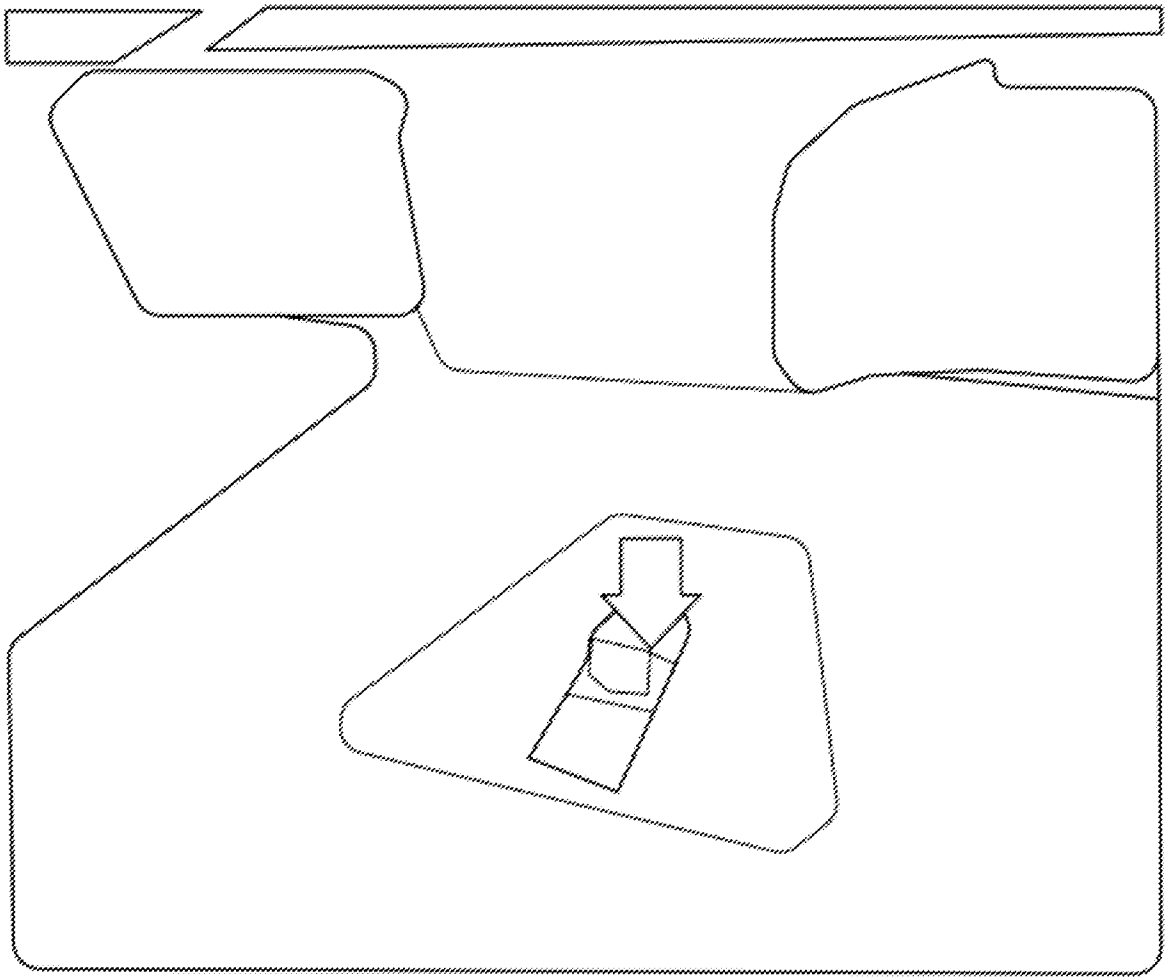
FIG. 21 provides an illustration of showing a door being opened so as to allow a tag body to slide out of the nest and into a container.

1554 involves releasing the tag body from the detacher. This release is achieved by retracting the latch mechanism (e.g., latch mechanism 1018 of FIG. 10) of the detaching unit (e.g., detaching unit 1004 of FIG. 10). The released tag body is then allowed to fall into a storage container (e.g., storage container 1412 of FIG. 14A) in 1556. If the tack assembly is integrated with or coupled to tag body, then it too will fall into the container in 1556. The tag body and/or tack assembly are allowed to fall by at least rotating or pivoting a portion of the nest from a home position (e.g., the position shown in FIG. 20) to a pivoted position (e.g., the position shown in FIG. 21). In addition to pivoting at least a portion of the nest, 1556 may additionally involve opening a trap door, rotating/swiveling the tag detacher, and/or actuating an ejection mechanism to eject the tag body from the nest. Techniques for opening trap doors and techniques for rotating, swiveling and/or ejecting objects are well known in the art, and therefore will not be described herein. Any known technique for opening trap doors and/or rotating/swiveling/ejecting objects can be used herein in accordance with a given application.

Figure 22:
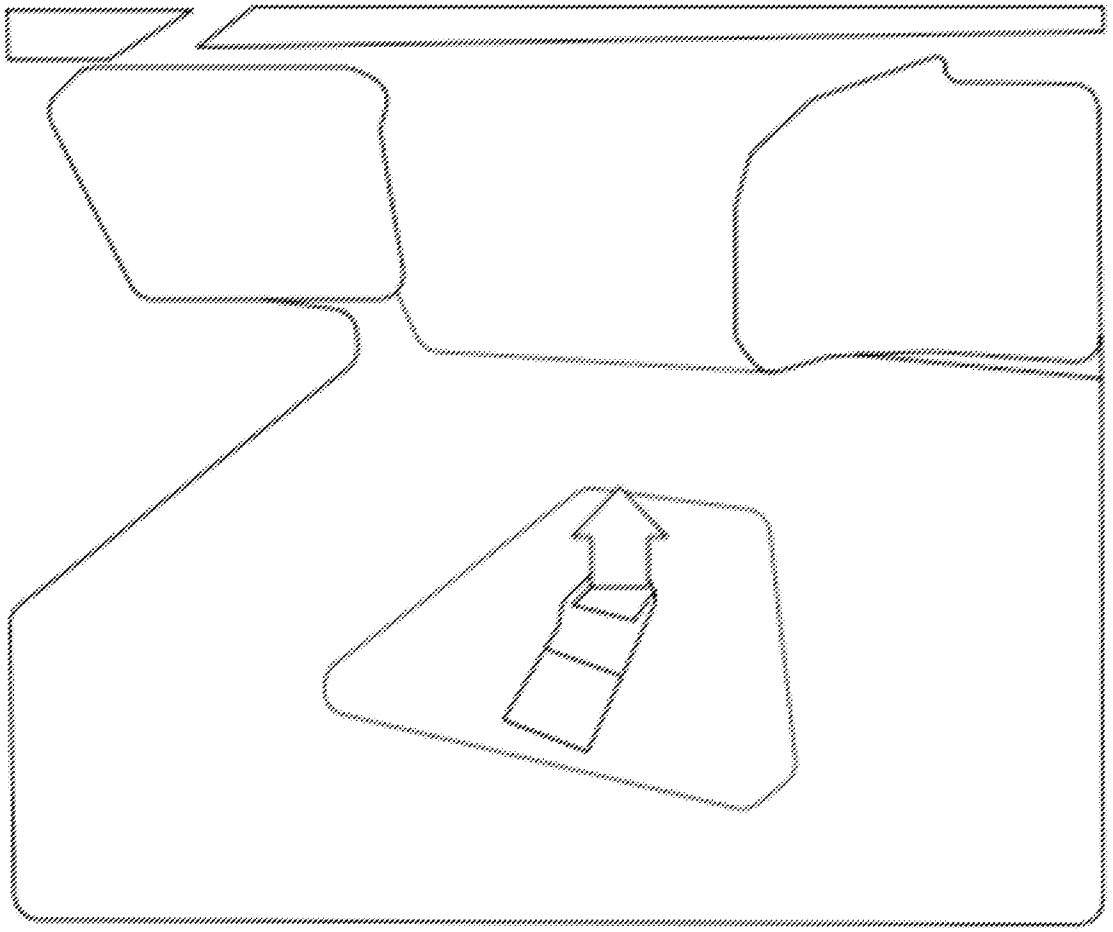
FIG. 22 provides an illustration showing the door being closed so as to prevent objects from sliding or falling out of the tag detacher's nest.

Next in 1556, the nest is returned to its home position. An illustration showing the nest being returned to its home position is provided in FIG. 22. Subsequently, 1560 is performed where method 1500 ends or the operations are performed (e.g., reset detacher and/or return to 1504 or 1506 of FIG. 15A).

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. A method for operating a tag detacher, comprising:

receiving a tag body of a security device in a nest of the tag detacher;

actuating a detachment mechanism of the tag detacher so as to cause a release of a tack assembly from a securement mechanism located within the tag body of the security device;

allowing the tag body to travel out of a nest by at least rotating the nest so that the nest transitions between a home position and a pivoted position; and returning the nest to the home position when the tag body no longer resides in the nest.

2. The method according to claim 1, further comprising determining, by the tag detacher, whether the tag body is properly placed in the nest, prior to an actuation of the detachment mechanism.

3. The method according to claim 2, further comprising outputting from the tag detacher a prompt for adjusting the tag body's position within the nest, when a determination is made that the tag body is not properly placed in the nest.

4. The method according to claim 2, further comprising actuating a latch mechanism to secure the tag body to the tag detacher, when a determination is made that the tag body is properly placed in the nest.

5. The method according to claim 1, further comprising performing operations by the tag detacher to determine whether there are any obstructions preventing access to the tack assembly, prior to an actuation of the detachment mechanism.

6. The method according to claim 5, further comprising outputting from the tag detacher a prompt for causing an individual to check for obstructions preventing access to the tack assembly, when a determination is made that there is an obstruction preventing access to the tack assembly.

7. The method according to claim 1, further comprising performing operations by the tag detacher to move a shield in proximity to the tack assembly, prior to an actuation of the detachment mechanism.

8. The method according to claim 7, further comprising using the shield to clamp an article to the tag detacher.

9. The method according to claim 8, further comprising performing operations by the tag detacher to move a shield out of proximity to the tack assembly, after the actuation of the detachment mechanism.

10. The method according to claim 1, further comprising performing capturing operations by the tag detacher to capture the tack assembly.

11. The method according to claim 10, wherein the capturing operations comprise actuating a mechanical device to grasp the tack assembly, generating a magnetic field to cause the tack assembly to be attracted to a magnetic surface, or operating a vacuum to collect the tack assembly.

12. The method according to claim 10, further comprising performing operations by the tag detacher to move the captured tack assembly over a storage container, and release the tack assembly so that the tack assembly travels into the storage container.

13. The tag detacher according to claim 12, further comprising at least one sensor that generates sensor data useful to determine whether there are any obstructions preventing access to the tack assembly, prior to an actuation of the detachment mechanism.

14. The tag detacher according to claim 13, further comprising an output device from which a prompt is output for causing an individual to check for obstructions preventing access to the tack assembly, when a determination is made that there is an obstruction preventing access to the tack assembly.

15. The tag detacher according to claim 12, further comprising a shield that is moved in proximity to the tack assembly, prior to an actuation of the detachment mechanism.

16. The tag detacher according to claim 15, wherein the shield is used to clamp an article to the tag detacher.

17. The tag detacher according to claim 15, wherein the shield is moved out of proximity of the tack assembly, after the actuation of the detachment mechanism.

18. The tag detacher according to claim 12, further comprising a capturing unit that captures the tack assembly by grasping the tack assembly, generating a magnetic field to cause the tack assembly to be attracted to a magnetic surface, or operating a vacuum to collect the tack.

19. The tag detacher according to claim 18, wherein the tag detacher moves the captured tack assembly over a storage container, and releases the tack assembly so that the tack assembly travels into the storage container.

20. A tag detacher, comprising:

a nest sized and shaped to receive a tag body of a security device;

a detachment mechanism that is actuable so as to cause a release of a tack assembly from a securement mechanism located within the tag body of the security device;

wherein the nest is transitionable between a home position in which the tag body is prevented from sliding or falling out of the nest and a pivoted position in which the tag body is allowed to slide or fall out of the nest; and wherein the nest is returned to the home position when the tag body no longer resides in the nest.

21. The tag detacher according to claim 20, further comprising at least one sensor that generates sensor data useful to determine whether the tag body is properly placed in the nest.

22. The tag detacher according to claim 21, further comprising an output device from which a prompt is output for adjusting the tag body's position within the nest, when a determination is made that the tag body is not properly placed in the nest.

23. The tag detacher according to claim 21, further comprising a latch mechanism that is actuable to secure the tag body to the tag detacher, when a determination is made that the tag body is properly placed in the nest.

* * * * *